US012157506B2

(12) United States Patent
Wolf et al.

(10) Patent No.: US 12,157,506 B2
(45) Date of Patent: Dec. 3, 2024

(54) WHEEL AXLE GUIDING ASSEMBLY WITH LONGITUDINAL HYDRO-MECHANICAL CONVERTERS AND ASSOCIATED RUNNING GEAR

(71) Applicants: Bombardier Transportation GmbH, Berlin (DE); Carl Freudenberg KG, Weinheim (DE)

(72) Inventors: Andreas Wolf, Winterthur (CH); Detlef Cordts, Wandlitz (DE); Dominique Wallet, Rombies et Marchipont (FR); Matthew Bradley, Alrewas (GB)

(73) Assignees: Bombardier Transportation GmbH, Berlin (DE); Carl Freudenberg KG, Weinheim (DE)

( * ) Notice: Subject to any disclaimer, the term of this patent is extended or adjusted under 35 U.S.C. 154(b) by 1848 days.

(21) Appl. No.: 15/998,573

(22) PCT Filed: Feb. 6, 2017

(86) PCT No.: PCT/EP2017/052557
§ 371 (c)(1),
(2) Date: Aug. 15, 2018

(87) PCT Pub. No.: WO2017/140523
PCT Pub. Date: Aug. 24, 2017

(65) Prior Publication Data

US 2019/0344811 A1 Nov. 14, 2019

(30) Foreign Application Priority Data

Feb. 15, 2016 (EP) ..... 16155620
Dec. 13, 2016 (EP) ..... 16203793

(51) Int. Cl.
*B61F 5/30* (2006.01)

(52) U.S. Cl.
CPC ..... *B61F 5/307* (2013.01)

(58) Field of Classification Search
CPC ..... B61F 5/307; B61F 5/386
See application file for complete search history.

(56) References Cited

U.S. PATENT DOCUMENTS 4,026,217 A 5/1977 Cross et al.
4,519,329 A * 5/1985 Vacher ..... B61F 5/383 91/44

(Continued)

FOREIGN PATENT DOCUMENTS

DE 3123858 C2 8/1991
DE 102013103827 A1 10/2014

(Continued)

*Primary Examiner* — Scott A Browne
(74) *Attorney, Agent, or Firm* — The Webb Law Firm

(57) ABSTRACT

The invention relates to a wheel axle guiding assembly comprising an axle box carrier, an axle box located longitudinally between a front part and a rear part of the axle box carrier; a front longitudinal hydro-mechanical converter between a front part of an axle box carrier and a rear longitudinal hydro-mechanical converter between the axle box and a rear part of the axle box carrier to allow a fore-and-aft movement of the axle box relative to the axle box carrier parallel to a longitudinal direction. Each of the front and rear longitudinal hydro-mechanical converters includes a housing, a plunger and an elastomeric body fixed to the housing and to the plunger so as to allow a fore-and-aft relative movement parallel to the longitudinal direction between the plunger and the housing, a single variable volume hydraulic chamber being formed between the housing, the plunger and the elastomeric body.

19 Claims, 16 Drawing Sheets

(56) References Cited

U.S. PATENT DOCUMENTS

| | | | | |
|---|---|---|---|---|
| 4,640,198 | A * | 2/1987 | Haupl | B61F 5/386<br>105/168 |
| 4,932,330 | A | 6/1990 | Herring, Jr. | |
| 2007/0175356 | A1 * | 8/2007 | Gedenk | B61F 5/307<br>105/224.1 |

FOREIGN PATENT DOCUMENTS

| | | | |
|---|---|---|---|
| EP | 1228937 | B1 | 9/2004 |
| EP | 1457706 | B1 | 11/2008 |
| WO | 2005091698 | A2 | 10/2005 |
| WO | 2013187006 | A1 | 12/2013 |
| WO | 2014170234 | A1 | 10/2014 |

* cited by examiner

WHEEL AXLE GUIDING ASSEMBLY WITH LONGITUDINAL HYDRO-MECHANICAL CONVERTERS AND ASSOCIATED RUNNING GEAR

CROSS-REFERENCE TO RELATED APPLICATIONS

This application is the United States national phase of International Application No. PCT/EP2017/052557 filed Feb. 6, 2017, and claims priority to European Patent Application Nos. 16155620.4 and 16203793.1 filed Feb. 15, 2016, and Dec. 13, 2016, respectively, the disclosures of which are hereby incorporated in their entirety by reference.

TECHNICAL FIELD OF THE INVENTION

The present invention relates to a wheel axle guiding assembly and to a running gear for a rail vehicle.

BACKGROUND ART

A two-axle bogie for a rail vehicle described in DE 31 23 858 C2 is provided with a wheel axle guiding assembly comprising: a pair of front left hydraulic cylinders for moving the left wheel of the front wheel set towards and away from a median transverse vertical plane of the bogie, a pair of front right hydraulic cylinders for moving the right wheel of the front wheel set towards and away from the median transverse vertical plane, a pair of rear left hydraulic cylinders for moving the left wheel of the rear wheel set towards and away from the median transverse vertical plane, a pair of rear right hydraulic cylinders for moving the left wheel of the rear wheel set towards and away from the median transverse vertical plane, and hydraulic connection to ensure that movements of the left, respectively right wheels of the front wheel set towards, respectively away from the median transverse vertical plane result in movements of the left, respectively right wheels of the front wheel set towards, respectively away from the median transverse vertical plane. In other words, the steering of the front and rear wheel sets is coordinated to negotiate tight curves of the track.

It has been suggested in EP1228937 to provide a bogie with specific bushings each mounted between one of the axle boxes and the bogie frame, said bushings comprising a cylindrical outer case, a bolt coaxially received within the outer case, and an elastomer body connecting the outer case to the bolt so as to form two chambers, which are located between the outer case and the bolt on opposite sides of the bolt. The two opposite chambers are filled with fluid. A fluid path is formed between the two chambers to allow a fore-and-aft movement of the bashing axle within the outer case. Further fluid connections may be provided to interconnect the chambers of the different bushings with a pressure source to constitute an active steering system. Due to the shape of the bushing, the amount of elastomer is limited, as well as the pumping area. As a result, the effectiveness and lifespan of these specific bushings is limited.

A similar bashing is disclosed in EP1457706. In order to obtain a stiffness that varies with the frequency, an arcuate channel is provided between the two chambers of the bashing. The frequency response of the bashing depends on the pumping area, as well as on the length and cross-section of the channel and, for a given set of parameters, the stiffness increases with the frequency. However, due to its size, the capabilities of the bashing are limited.

A running gear unit for a rail vehicle, having a running gear frame, supported on a pair of wheel sets via a primary suspension system is disclosed in WO2014170234. The two wheel sets are coupled with one another via a coupling arrangement in such a way that a first transverse displacement of the first wheel set with respect to the running gear frame in the transverse direction results in a second, identically directed transverse displacement of the second wheel set with respect to the running gear frame in the transverse direction. Concurrently, the coupling arrangement is such that a first rotation of the first wheel set with respect to the running gear frame about a vertical axis results in a second rotation in the opposite direction of the second wheel set with respect to the running gear frame. The coupling arrangement comprises bushings each comprising a cylindrical outer case, a bolt coaxially received within the outer case, and an elastomer body connecting the outer case to the bolt so as to form four chambers. Due to their size, the capabilities of the bushings are limited.

A primary suspension system disclosed in U.S. Pat. No. 4,932,330 includes a pair of spaced vertical springs connected between a journal bearing retainer and a side frame of a railway truck. Pairs of angularly disposed elastomeric springs are also connected between a lower support housing and opposite angular ends of the journal bearing retainer to provide lateral and longitudinal stiffness. However, these elastomeric springs do not provide a frequency dependent stiffness.

A railway bogie illustrated in WO 2005/091698 is provided with an axle box, a bogie frame and a primary suspension between the axle box and the bogie frame, wherein the primary suspension comprises to hydraulic springs, and the axle revolution axis defined by the axle box is located between the two hydraulic springs.

SUMMARY OF THE INVENTION

The invention aims to provide wheel axle guiding assemblies with more robust hydro-mechanical converters that provide long strokes and improved capabilities, within the space requirement of conventional running gears.

According to a first aspect of the invention, there is provided a wheel axle guiding assembly comprising:

- an axle box defining a horizontal revolution axis and a longitudinal horizontal direction perpendicular to the revolution axis;
- an axle box carrier; and
- a front longitudinal hydro-mechanical converter fixed to a front interface of the axle box and a front interface of the axle box carrier and a rear longitudinal hydro-mechanical converter fixed to a rear interface of the axle box and a rear interface of the axle box carrier to allow a fore-and-aft movement of the axle box relative to the axle box carrier parallel to the longitudinal direction; wherein each of the front and rear longitudinal hydro-mechanical converters includes a housing, a plunger and an elastomeric body fixed to the housing and to the plunger so as to allow a fore-and-aft relative movement parallel to the longitudinal direction between the plunger and the housing, a single variable volume hydraulic chamber being formed between the housing, the plunger and the elastomeric body, each of the front and rear longitudinal hydro-mechanical converters further including a hydraulic port for connecting the variable volume hydraulic chamber to an external hydraulic circuit.

As one hydro-mechanical converter is provided on each side of the axle boxes and each hydro-mechanical converter is provided with a single variable volume chamber between the plunger and the housing, more room is available for each variable volume chamber than the prior art. Both the effective pumping area and the stroke of the hydro-mechanical converters can be increased. The larger effective pumping area and a larger size of the elastomeric body are predominant factors for defining a stiffer dynamic response, which takes advantage from a large pumping area, and a greater ratio between the dynamic stiffness and the static stiffness of the wheel axle guiding assembly.

Preferably the axle box houses a bearing having an inner diameter defining a cross-sectional area $A_\Phi$ of an end of a wheel axle to be received in the bearing and the plunger has an effective area $A_e$ measured in a plane perpendicular to the longitudinal direction, which is greater than half the cross-sectional area $A_\Phi$, preferably greater than the cross-sectional area $A_\Phi$.

The elastomeric body is annular, preferably with a circular, elliptic or rectangular cross-section between the plunger and the housing. According to a preferred embodiment and in order not to overstress the elastomeric body, the elastomeric body can be fixed to an annular cylindrical or frustro-conical surface of the housing facing the plunger and an annular cylindrical or frustro-conical surface of the plunger facing the housing.

Preferably, each of the front and rear longitudinal hydro-mechanical converters has a longitudinal stiffness, which increases with a frequency of the fore-and-aft movement of the axle box relative to the axle box carrier from a quasistatic stiffness value to a dynamic stiffness value, wherein the plunger and the elastomeric body have dimensions such that a ratio R of the dynamic stiffness value to the quasistatic stiffness value is greater than 10, preferably greater than 20, preferably greater than 50. As a result, the wheel axle guiding assembly has a soft response to quasistatic longitudinal loads, in particular passive steering movement, and simultaneously efficiently counteracts hunting oscillations at higher frequencies.

An abutment may be provided between the plunger and the housing for limiting a contraction movement of the plunger. In order to increase comfort, the abutment is preferably provided with an elastomeric buffer.

According to a preferred embodiment, the wheel axle guiding assembly further comprises a vertical suspension unit provided between the axle box and an upper part of the axle box carrier. The vertical suspension unit is preferably independent from the longitudinal hydro-mechanical converters, in order to control the stiffness and deflection in the vertical direction independently from the longitudinal direction. According to one embodiment, the vertical suspension unit comprises a chevron spring having a V-shaped cross-section in a vertical transversal plane parallel to the revolution axis. The vertical suspension unit also provides stiffness in the transverse direction, i.e. the direction parallel to the revolution axis of the axle box. Alternatively the vertical suspension unit comprises a sandwich spring having a set of planar elastomeric elements extending in a horizontal plane. In order to take advantage of the room available below the axle box, the vertical suspension unit may be provided with an elastomeric pad between the axle box and a lower part of the axle box carrier.

If the deflection of the axle box in the vertical and/or transverse direction is significant, e.g. because the vertical suspension unit has a low stiffness, it may be advisable to release the hydro-mechanical converters from the corresponding displacements. To this end, each of the front and rear longitudinal hydro-mechanical converters further comprises a decoupling spring with a longitudinal stiffness at least ten times, preferably at least twenty times, preferably fifty times greater than a longitudinal stiffness of the elastomeric body, a lateral stiffness less than a two times the lateral stiffness of the elastomeric body, preferably less than the lateral stiffness of the elastomeric body and a vertical stiffness less than two times the vertical stiffness of the elastomeric body, preferably less than the vertical stiffness of the elastomeric body.

In all embodiments and by definition, the front interface of the axle box is located longitudinally in front of the rear interface of the axle box. Similarly, the front interface of the axle box carrier is located in front of the rear interface of the axle box carrier. In practice, the front interface of the axle box faces the front interface of the axle box carrier and the rear interface of the axle box faces the rear interface of the axle box carrier. According to one embodiment, the front interface and the rear interface of the axle box carrier are located between the front interface and the rear interface of the axle box. This embodiment proves particularly interesting when a running gear to be retrofitted does not have the same available free space in front and behind the axle box in the longitudinal direction. According to an alternative embodiment, the revolution axis is located longitudinally between the front interface and a rear interface of the axle box carrier. In particular, the axle box can be located longitudinally between a front part and a rear part of the axle box carrier. According to one specific embodiment, the axle box carrier forms a ring around the axle box.

According to one embodiment, a vertical suspension assembly connects the axle box carrier to a running gear frame. The vertical suspension units between the axle box carrier and the running gear frame will allow deflection of substantial magnitude in the vertical direction, without negatively impacting the longitudinal hydro-mechanical converters. If vertical suspension units are provided both between the axle box and the axle box carrier and between the axle box carrier and the running gear frame, the latter will preferably have a lower stiffness than the former, preferably more than 1.5 times lower.

According to an alternative embodiment, the axle box carrier is a constituent portion of a running gear frame of a running gear. This will be possible in particular with a flexible running gear frame.

According to one embodiment, a hydraulic reservoir is hydraulically connected to the hydraulic chamber, preferably with a check valve allowing a flow of a fluid only from the hydraulic reservoir to the hydraulic chamber, preferably with a volume at least twice the volume of the hydraulic chamber. The hydraulic reservoir provides a temperature compensation volume and delivers additional hydraulic fluid to offset losses in the hydraulic circuit and maintain the function of the system for an extra period of time in case of leakage. The reservoir may advantageously be provided with a leakage indicator. The hydraulic reservoir may be connected to the hydraulic chamber via an appropriate valve arrangement, in particular a check valve, to ensure a fail-safe operation.

According to another aspect of the invention, there is provided a running gear for a rail vehicle, comprising at least a pair of wheel axle guiding assemblies as described above, a first hydraulic circuit for establishing a hydraulic connection between a first variable volume hydraulic chamber and a second variable volume hydraulic chamber, and a second hydraulic circuit for establishing a hydraulic connection between a third variable volume hydraulic chamber and a fourth variable volume hydraulic chamber, the first, second, third and fourth variable volume hydraulic chambers being all different chambers and each of the first, second, third and fourth variable volume hydraulic chambers being the variable volume hydraulic chamber of one of the front and rear longitudinal hydro-mechanical converters of one of the wheel axle guiding assemblies of the pair of wheel axle guiding assemblies. Preferably, the first and/or the second hydraulic circuit further comprise a hydraulic reservoir. The hydraulic connection between variable volume hydraulic chambers is effective to allow a circulation of fluid and a balance of pressures when the wheel sets are subjected to quasistatic load.

One option is to connect the variable volume chamber of the front longitudinal hydro-mechanical converter of each wheel axle guiding assembly with the variable volume chamber of the rear longitudinal hydro-mechanical converter of the same wheel axle guiding assembly.

Preferred alternative embodiments, however, dispense with any hydraulic connection between the chamber of the front longitudinal hydro-mechanical converter and the chamber of the rear longitudinal hydro-mechanical converter of the same wheel axle guiding assembly.

Another option is to connect the variable volume chamber of the front longitudinal hydro-mechanical converter of one wheel axle guiding assembly on each lateral side of the running gear with the variable volume chamber of the rear longitudinal hydro-mechanical converter of the other wheel axle guiding assembly on the same lateral side of the running gear and to connect the variable volume chamber of the rear longitudinal hydro-mechanical converter of said one wheel axle guiding assembly on each lateral side of the running gear with the variable volume chamber of the front longitudinal hydro-mechanical converter of said other wheel axle guiding assembly on the same lateral side of the running gear.

Preferably, the first hydraulic circuit establishes a hydraulic connection between the variable volume hydraulic chamber of the front longitudinal hydro-mechanical converter of one of the wheel axle guiding assemblies of the pair of the wheel axle guiding assemblies and the variable volume hydraulic chamber of the front longitudinal hydro-mechanical converter of the other of the wheel axle guiding assemblies of the pair of the wheel axle guiding assemblies and second hydraulic circuit establishes a hydraulic connection between the variable volume hydraulic chamber of the rear longitudinal hydro-mechanical converter of one of the wheel axle guiding assemblies of the pair of the wheel axle guiding assemblies and the variable volume hydraulic chamber of the rear longitudinal hydro-mechanical converter of the other of the wheel axle guiding assemblies of the pair of the wheel axle guiding assemblies.

According to one embodiment, the running gear further comprises at least a front wheel set and a rear wheel set and the such that an end of the front wheel set is supported by the axle box of a front wheel axle guiding assembly of the pair of wheel axle guiding assemblies and that an end of the rear wheel set is supported by the axle box of a rear wheel axle guiding assembly of the pair of wheel axle guiding assemblies. In particular, one option is to connect the variable volume chamber of the front longitudinal hydro-mechanical converter of one wheel axle guiding assembly on each lateral side of the running gear with the variable volume chamber of the front longitudinal hydro-mechanical converter of the other wheel axle guiding assembly on the same lateral side of the running gear and similarly for the variable volume chambers of the rear longitudinal hydro-mechanical converters. This will ensure that the two-wheel sets will rotate in opposite direction about a vertical axis. Another option with similar effect is to connect the variable volume chamber of the front longitudinal hydro-mechanical converter of one wheel axle guiding assembly on each lateral side of the running gear with the variable volume chamber of the rear longitudinal hydro-mechanical converter of the other wheel axle guiding assembly on the other lateral side of the running gear and similarly between the two other variable volume chambers, to form a cross connection.

According to a most preferred option, however, the running gear comprises at least one wheel set, a left end of the wheel set is supported by the axle box of a left wheel axle guiding assembly of the pair of wheel axle guiding assemblies, and a right end of the wheel set is supported by the axle box of a right wheel axle guiding assembly of the pair of wheel axle guiding assemblies. With this embodiment, the longitudinal translation movement of the wheel set are limited, e.g. when the vehicle accelerates or decelerates, whilst the rotation of the wheel set about a vertical axis is still possible. Moreover, this embodiment provides a fail-safe operating mode in case of leakage.

Preferably, the running gear does not include any hydraulic connection between the chamber of the front longitudinal hydro-mechanical converter and the chamber of the rear longitudinal hydro-mechanical converter of the same wheel axle guiding assembly.

According to a first aspect of the invention, there is provided a wheel axle guiding assembly comprising:

- an axle box defining a horizontal revolution axis and a longitudinal horizontal direction perpendicular to the revolution axis;
- an axle box carrier, the axle box being located longitudinally between a front part and a rear part of the axle box carrier; and
- a front longitudinal hydro-mechanical converter fixed to the axle box and the front part of the axle box carrier and a rear longitudinal hydro-mechanical converter fixed to the axle box and the rear part of the axle box carrier to allow a fore-and-aft movement of the axle box relative to the axle box carrier parallel to the longitudinal direction; wherein each of the front and rear longitudinal hydro-mechanical converters includes a housing, a plunger and an elastomeric body fixed to the housing and to the plunger so as to allow a fore-and-aft relative movement parallel to the longitudinal direction between the plunger and the housing, a single variable volume hydraulic chamber being formed between the housing, the plunger and the elastomeric body, each of the front and rear longitudinal hydro-mechanical converters further including a hydraulic port for connecting the variable volume hydraulic chamber to an external hydraulic circuit.

BRIEF DESCRIPTION OF THE FIGURES

Other advantages and features of the invention will then become more clearly apparent from the following description of a specific embodiment of the invention given as non-restrictive examples only and represented in the accompanying drawings in which.

Corresponding reference numerals refer to the same or corresponding parts in each of the figures.

DETAILED DESCRIPTION OF PREFERRED EMBODIMENTS

Figure 1:
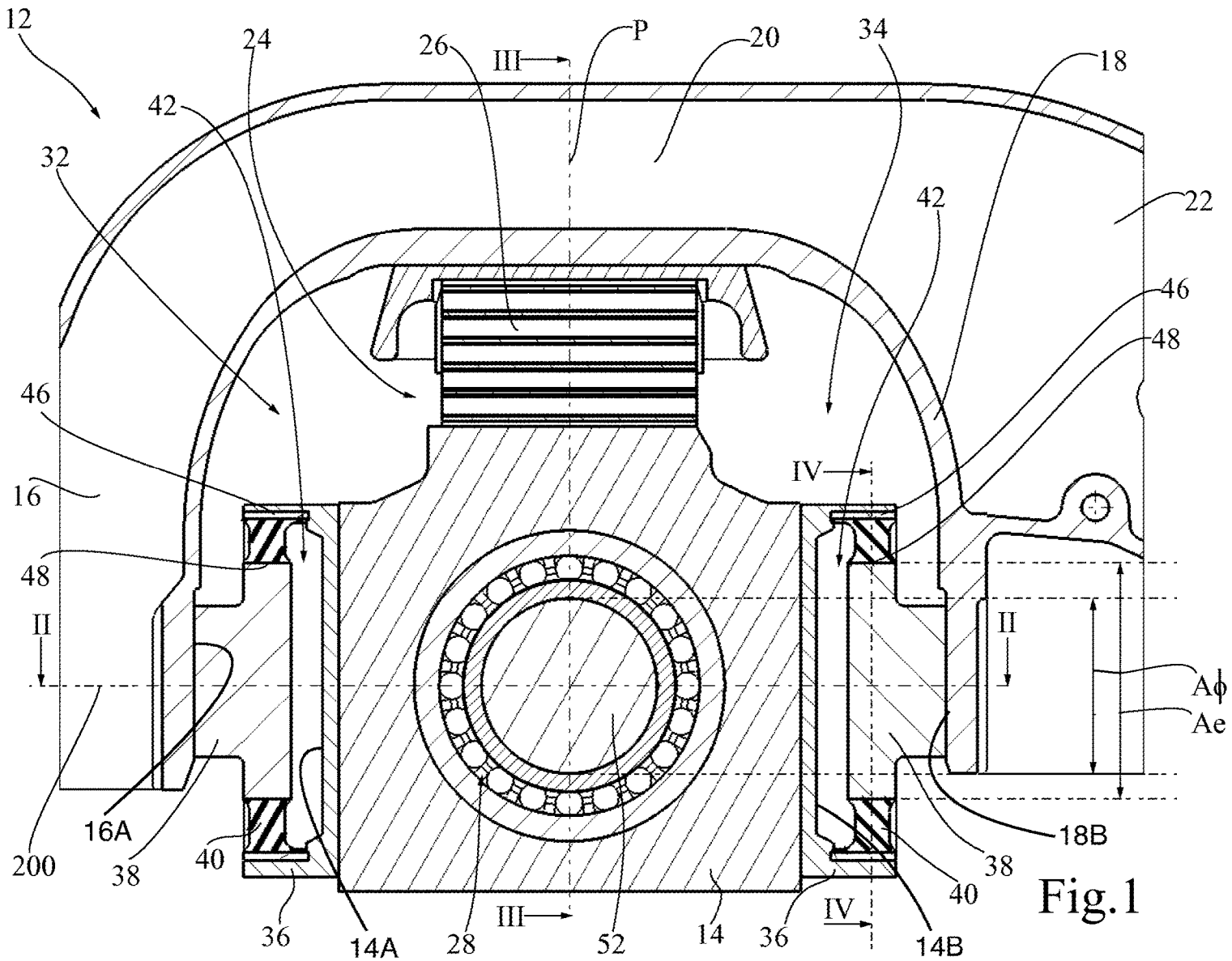
FIG. 1 illustrates a longitudinal section of a wheel axle guiding assembly for a running gear of a rail vehicle according to a first embodiment of the invention by a longitudinal vertical plane along section line I-I of FIG. 3.
Figure 2:
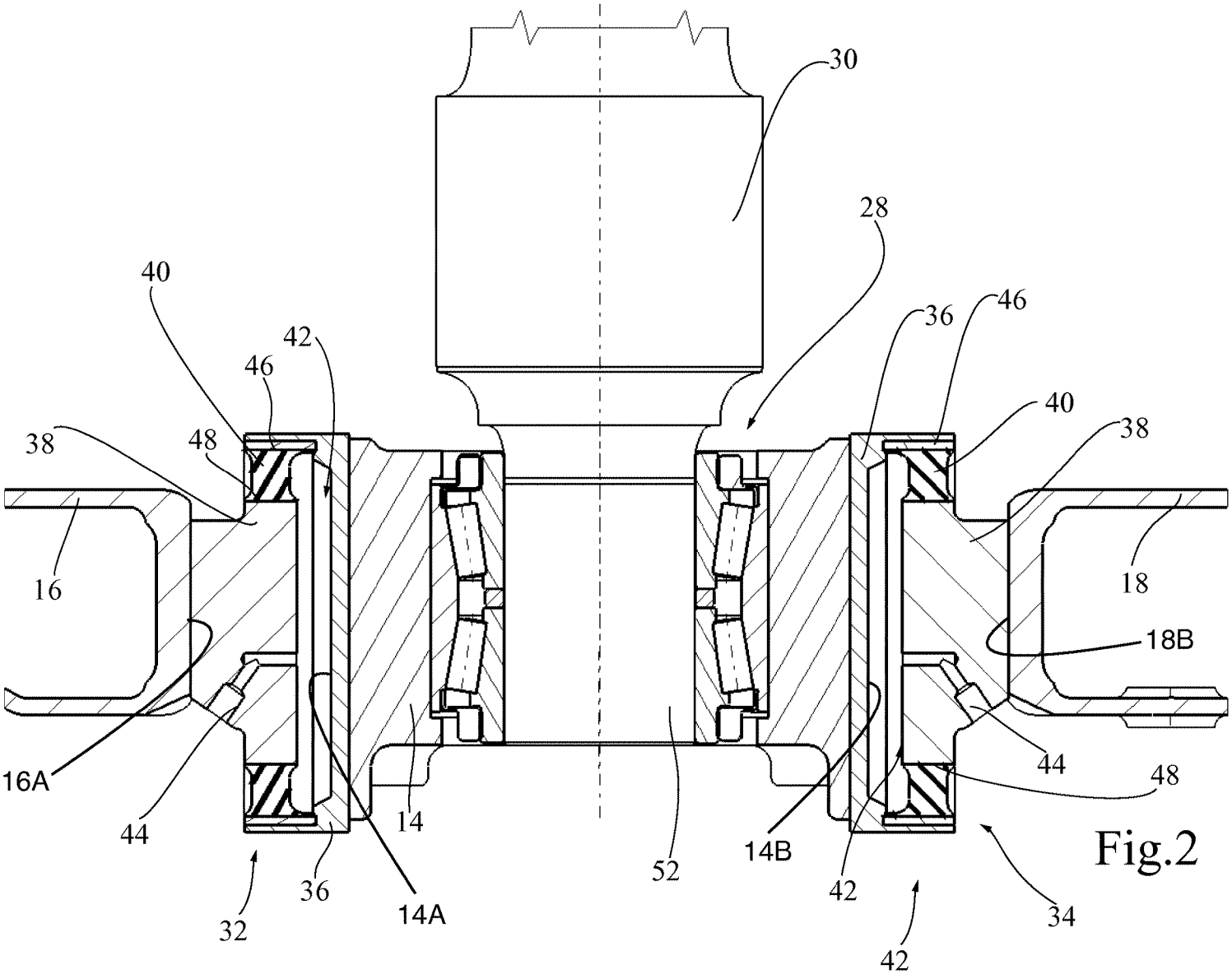
FIG. 2 illustrates a section of the wheel axle guiding assembly of FIG. 1 by a horizontal plane along section line II-II of FIG. 1.
Figure 3:
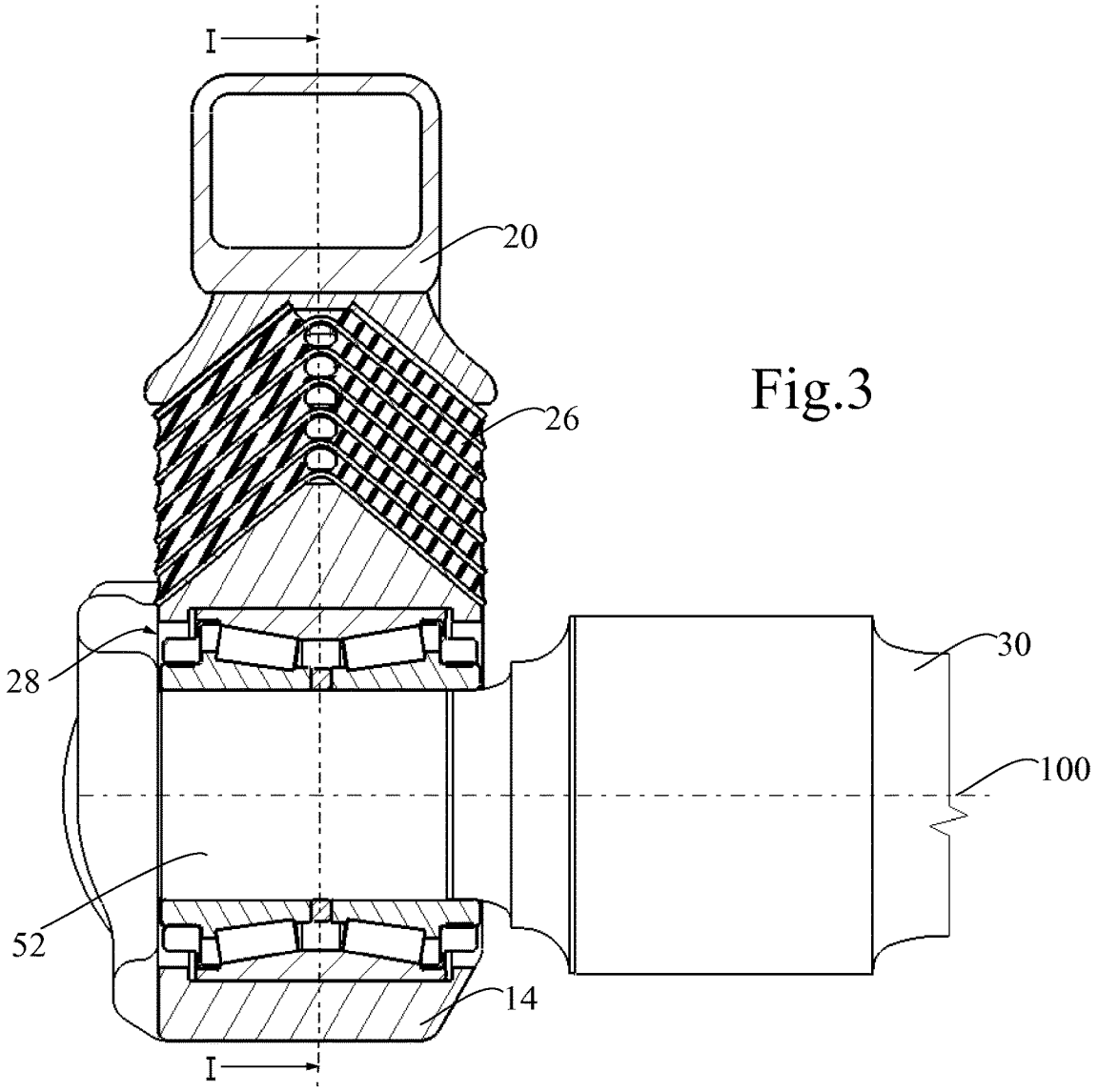
FIG. 3 is a vertical section of the wheel axle guiding assembly of FIG. 1, along section line III-III of FIG. 1.
Figure 4:
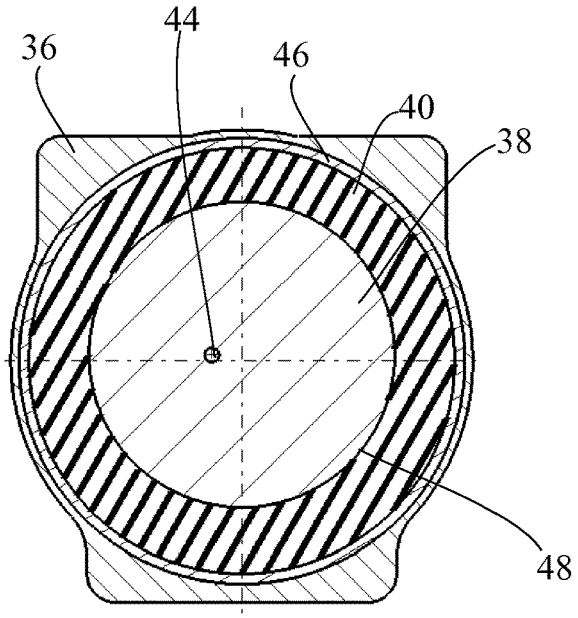
FIG. 4 is a vertical section along section line IV-IV of FIG. 1.

A wheel axle guiding assembly 10 for a running gear 12 of a rail vehicle is illustrated in FIGS. 1 to 4. This wheel axle guiding assembly 10 comprises an axle box 14 located longitudinally between a front part 16 and a rear part 18 of an axle box carrier 20 formed by a C-shaped end portion of a frame 22 of the running gear 12. The axle box carrier 20 is supported on the axle box 14 by way of a vertical primary suspension unit 24, which comprises a chevron spring 26 having a V-shaped cross-section in a vertical transversal plane parallel to a revolution axis 100 defined by the axle box 14. As is well known in the art, the axle box 14 houses a bearing 28, usually a roller bearing, for guiding an end portion of a wheel axle 30.

A front longitudinal hydro-mechanical converter 32 is fixed to a front interface 14A of the axle box 14 and to a front interface 16A of the axle box carrier 20 formed by the front part 16 of the axle box carrier 20 and a rear longitudinal hydro-mechanical converter 34 is fixed to a rear interface 14B of the axle box 14 and to a front interface 18B of the axle box carrier 20 formed by the rear part 18 of the axle box carrier 20 to allow a fore-and-aft movement of the axle box 14 relative to the axle box carrier 20 parallel to a longitudinal direction 200. The longitudinal direction 200 in this context and in the whole application is the horizontal direction perpendicular to the horizontal revolution axis 100 defined by the axle box in a reference position. Each of the front and rear longitudinal hydro-mechanical converters 32, 34 includes a housing 36 fixed to the axle box 14 or integral with the axle box 14, a plunger 38 fixed to or integral with the axle box carrier 20 and an annular elastomeric body 40 adhered by vulcanisation or otherwise fixed in a sealed manner to the housing 36 and to the plunger 38 so as to form a single variable volume hydraulic chamber 42 between the housing 36, the plunger 38 and the elastomeric body 40. A hydraulic inlet and outlet port 44 (see FIG. 2) is provided for connecting the variable volume hydraulic chamber 42 to a hydraulic circuit, as will be discussed later on in connection with FIGS. 9 to 13.

In this preferred embodiment, the interface 46 between the annular elastomeric body 40 and the housing 36 and the interface 48 between the annular body 40 and the plunger 38 are cylindrical and coaxial. This ensures that the annular elastomeric body 40 is only subjected to shear stress when the plunger 38 and housing 36 move relative to one another in the longitudinal direction 200. The radial dimension of the annular body 40, i.e. the distance between the two interfaces 46, 48 is preferably greater than its longitudinal dimension.

This arrangement result in a low stiffness of each longitudinal hydro-mechanical converter 32, 34 in the longitudinal direction 200 while the stiffness is much higher in the radial directions, notably in the vertical and transverse directions. The chevron spring 26 has a stiffness which is higher than the hydro-mechanical converters 32, 34 in the vertical and transverse directions but lower in the longitudinal direction 200. As a result, the vertical primary suspension unit 24 is the main path for vertical loads and shares the transverse load with the hydro-mechanical converters 32, 34, which form the main path for longitudinal loads.

Due to its geometry, and in particular to their large pumping area, the hydro-mechanical converters 32, 34 have a stiffness, which significantly increases with the frequency of the applied load, as become more apparent from the discussion below.

When the axial load varies at a very low frequency, the hydraulic fluid moves in and out of the variable volume hydraulic chamber 42 through the hydraulic port 44 in phase with the motion of the plunger 38 relative to the housing 36. The static stiffness $C_{static}$ of the hydro-mechanical converter depends mainly on the geometry of the elastomeric body 40 and decreases when the ratio of the radial dimension to the longitudinal dimension of the elastomeric body 40 increases.

When the frequency of the longitudinal movement of the axle boxes 14 increases, the motion of the hydraulic fluid in and out of the hydraulic chambers 42 is increasingly out of phase with the relative motion between the plunger 38 and the housing 36. When the frequency is sufficiently high the hydraulic chambers 42 can be almost considered as closed chambers, since the movement of the fluid in and out of the chambers becomes insignificant. The behaviour is dependent on the viscosity of the fluid and the hydraulic circuit connecting the chambers, in particular the length and diameter of the connecting pipes. Relative fore and aft movement between the plunger and the housing is still possible despite the incompressible fluid in the hydraulic chamber thanks to a dynamic swell deformation of the elastomeric body 40. The elastomeric body 40 is therefore characterised by a dynamic swell stiffness $C_{swell}$ which is added to the static stiffness $C_{static}$ at higher frequencies. This dynamic swell stiffness increases approximately linearly with the effective pumping area A of the hydro-mechanical converter, which is the ratio of the elementary variation of volume ΔV of the chamber to the corresponding elementary longitudinal relative movement Lx between the plunger and the housing:

$$C_{swell} \approx K \cdot A = K\frac{\Delta V}{\Delta x}$$

In practice, the pumping area A is greater than or equal to the effective area $A_e$ of the plunger, i.e. the area of the geometric projection of the surface of the plunger within the housing on a plane P perpendicular to the longitudinal direction. In other words, the greater the effective area $A_e$ of the plunger, the greater the pumping area A, the dynamic swell stiffness $S_{swell}$ and the ratio R of the dynamic stiffness to the static stiffness of the longitudinal hydro-mechanical converter 32, 34. As a rule of thumb, the effective area $A_e$ of the plunger should preferably be greater than half the area of the cross-section $A_\Phi$ of the wheel axle measured in a plane perpendicular to the rotation axis of the wheel axle passing through a roller bearing of the axle box:

$$A \geq A_e \geq \frac{A_\phi}{2}$$

Thanks to the geometry of the arrangement of the hydro-mechanical converters on each side of the wheel axle, the effective pumping area A can be large, and the dynamic stiffness, will also be very large. Concurrently, the static stiffness can be kept low, which leads to a high ratio of the dynamic stiffness to the static stiffness, preferably of more than 10, preferably of more than 20, and preferably more than 50.

Due to this high ratio of the dynamic stiffness to the static stiffness, the wheel axle guiding assembly provides a smooth response to the various longitudinal loads at low frequency and a stiffer response at higher frequency, which is particularly advantageous. The wheel axle guiding assembly will respond with a very low stiffness $C_{static}$ to quasistatic longitudinal loads so that the wheel axle 30 will naturally rotate about a vertical axis and find their position in a curve. The stroke of the longitudinal hydro-mechanical converters 32, 34 is greater than with conventional elastomeric or hydro-elastic bushings, which ensures a sufficient deflection of the wheel axle 30 in curves. In response to high frequency longitudinal vibrations, on the other hand, the system will provide a high dynamic stiffness that includes the component $C_{swell}$ so as to efficiently counteract hunting oscillations and provide an excellent stability.

The cutoff frequency in the frequency response of the system depends not only on the characteristic of the hydro-mechanical converters 32, 34 but also on the characteristics of the hydraulic circuit. Preferably, the cutoff frequency should be less than 4 Hz, ideally between 0.5 Hz and 1.5 Hz.

Figure 5:
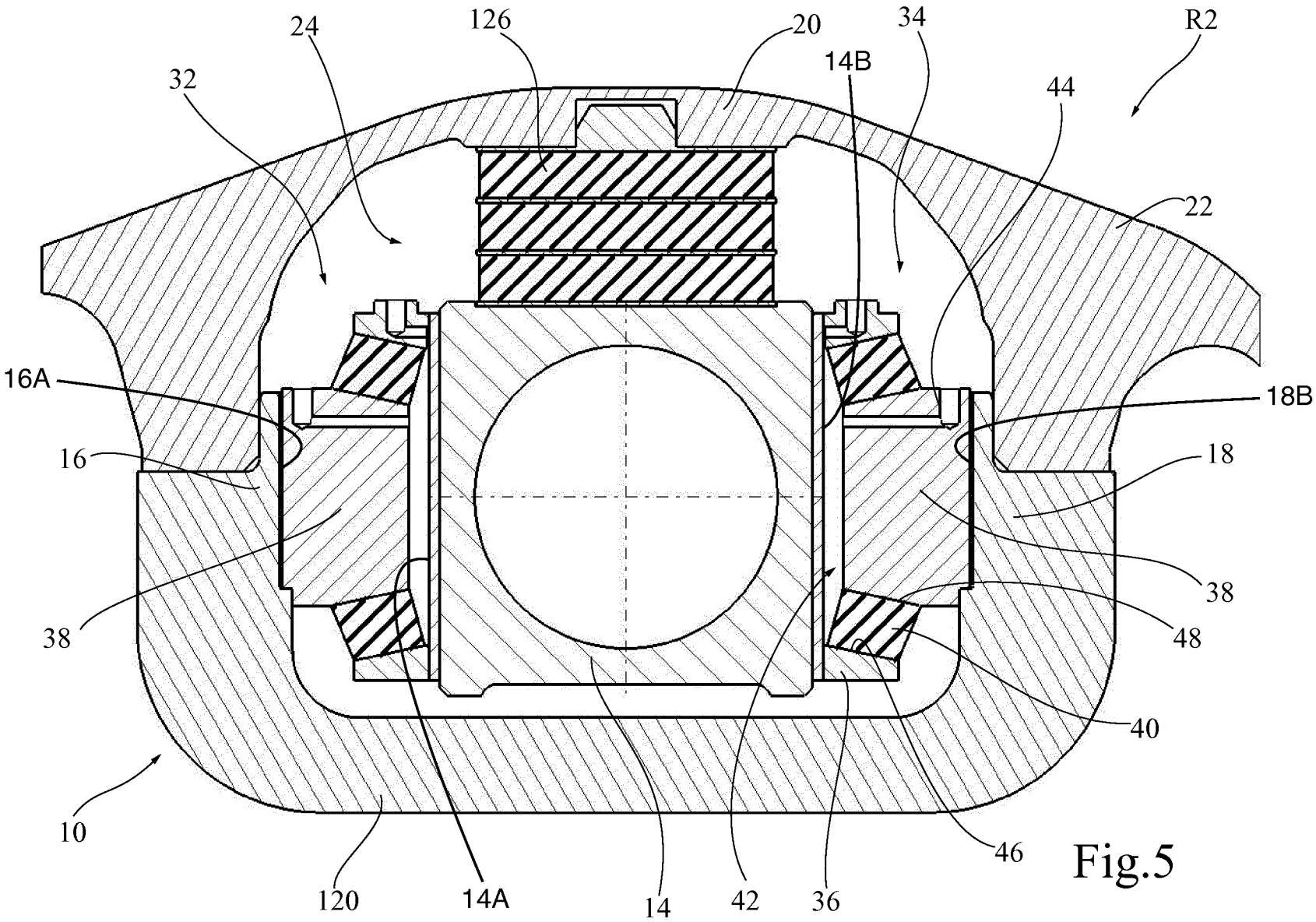
FIG. 5 is a longitudinal section of a wheel axle guiding assembly according to a second embodiment of the invention.

A wheel axle guiding assembly 10 for a running gear 12 of a rail vehicle according to a second embodiment of the invention is illustrated in FIG. 5. This wheel axle guiding assembly 10 comprises an axle box 14 located longitudinally between a front part 16 and a rear part 18 of a ring-shaped axle box carrier 20 formed by a C-shaped end portion of a frame 22 of the running gear and a C-shaped lower bracket 120. The axle box carrier 20 is supported on the axle box 14 by way of a vertical primary suspension unit 24, which comprises a sandwich spring 126 having a set of planar elastomeric elements extending in a horizontal plane.

A front longitudinal hydro-mechanical converter 32 is fixed to the axle box 14 and to the front part 16 of the axle box carrier 20 and a rear longitudinal hydro-mechanical converter 34 fixed to the axle box 14 and to the rear part 18 of the axle box carrier 20 to allow a fore-and-aft movement of the axle box 14 relative to the axle box carrier 20 parallel to the longitudinal direction 200 of the running gear 12. Each of the front and rear longitudinal hydro-mechanical converters 32, 34 includes a housing 36 fixed to or integral with the axle box 14, a plunger 38 fixed to or integral with the axle box carrier 20 and an annular elastomeric body 40 adhered by vulcanisation or otherwise fixed in a sealed manner to the housing 36 and to the plunger 38 so as to form a single variable volume hydraulic chamber 42 between the housing 36, the plunger 38 and the elastomeric body 40. In this embodiment, the interface between the annular elastomeric body and the plunger is frustum-shaped and coaxial with the interface between the annular body and the housing.

This arrangement results in a low stiffness of each longitudinal hydro-mechanical converter 32, 34 in the longitudinal direction while the stiffness is much higher in the radial directions, notably in the vertical and transverse directions. The sandwich spring 126 has a static stiffness, which is higher than the hydro-mechanical converters 32, 34 in the vertical directions but lower in the longitudinal and transverse directions. As a result, the sandwich spring 126 is the main path for vertical loads while the hydro-mechanical converters 32, 34 form the main path for longitudinal and transverse loads. The response of the wheel axle guiding assembly 10 of FIG. 5 to static and dynamic longitudinal loads is essentially similar to that of the first embodiment.

Figure 6:
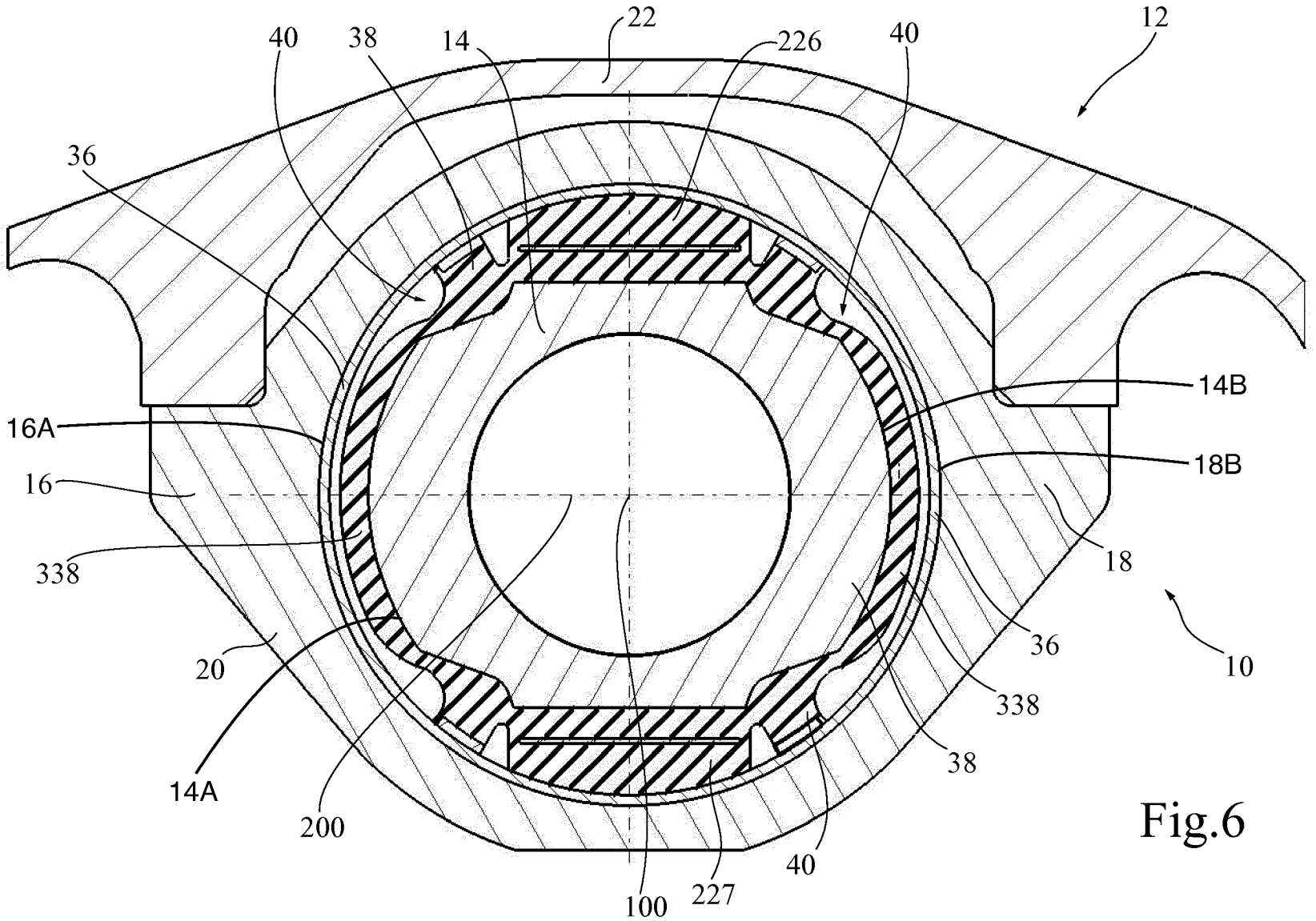
FIG. 6 is a longitudinal section of a wheel axle guiding assembly according to a third embodiment of the invention.
Figure 7:
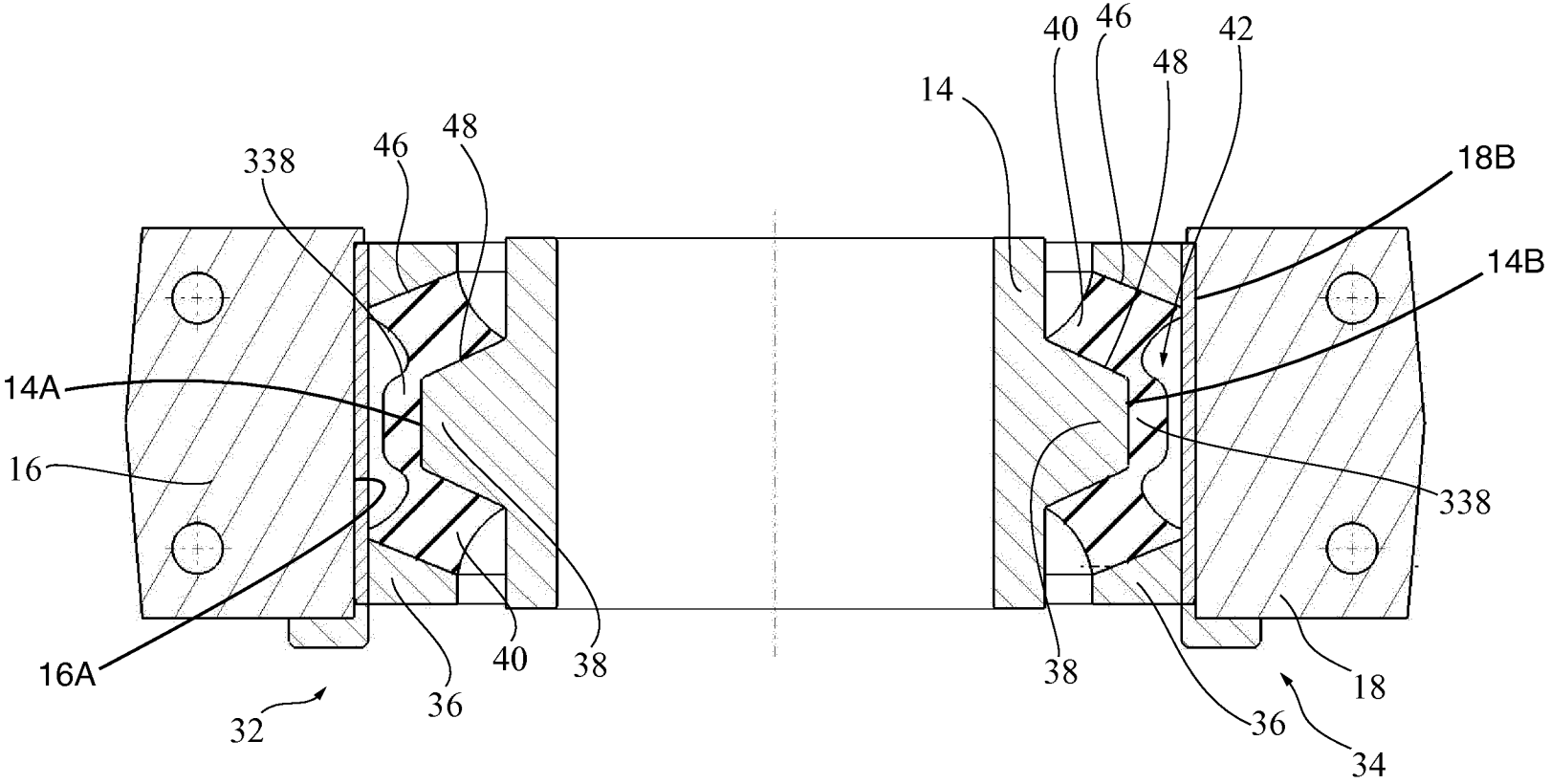
FIG. 7 illustrates a section of the wheel axle guiding assembly of FIG. 6 by a horizontal plane.

A wheel axle guiding assembly 10 for a running gear 12 of a rail vehicle according to a third embodiment of the invention is illustrated in FIGS. 6 and 7. This wheel axle guiding assembly 10 comprises an axle box 14 located longitudinally between a front part 16 and a rear part 18 of an axle box carrier 20 formed by a ring-shaped frame element fixed to the frame 22 of the running gear 12. The axle box carrier 20 is supported on the axle box 14 by way of a vertical primary suspension unit 24, which comprises an upper elastomeric pad 226 and a lower elastomeric pad 227. A front longitudinal hydro-mechanical converter 32 is provided between the axle box 14 and the front part 16 of the axle box carrier 20 and a rear longitudinal hydro-mechanical converter 34 is provided between the axle box 14 and the rear part 18 of the axle box carrier 20 to allow a fore-and-aft movement of the axle box 14 relative to the axle box carrier 20 parallel to the longitudinal direction 200 of the running gear 12. Each of the front and rear longitudinal hydro-mechanical converters 32, 34 includes a housing 36 fixed to the axle box carrier 20 or integral with the axle box carrier 20, a plunger 38 integral with the axle box 14 and an annular elastomeric body 40 adhered by vulcanisation or otherwise fixed in a sealed manner to the housing 36 and to the plunger 38 so as to form a single variable volume hydraulic chamber 42 between the housing 36, the plunger 38 and the elastomeric body 40. In this embodiment, the interface 46, 48 between the annular elastomeric body 40 and the housing 36 and between the annular body 40 and the plunger 38 are tapered. An elastomeric buffer 338 forms an abutment between the plunger 38 and the housing 36 for limiting a contraction movement of the hydro-mechanical converter 32, 34. The response of the wheel axle guiding assembly of FIGS. 6 and 7 to static and dynamic longitudinal loads is essentially similar to that of the previous embodiments.

Figure 8:
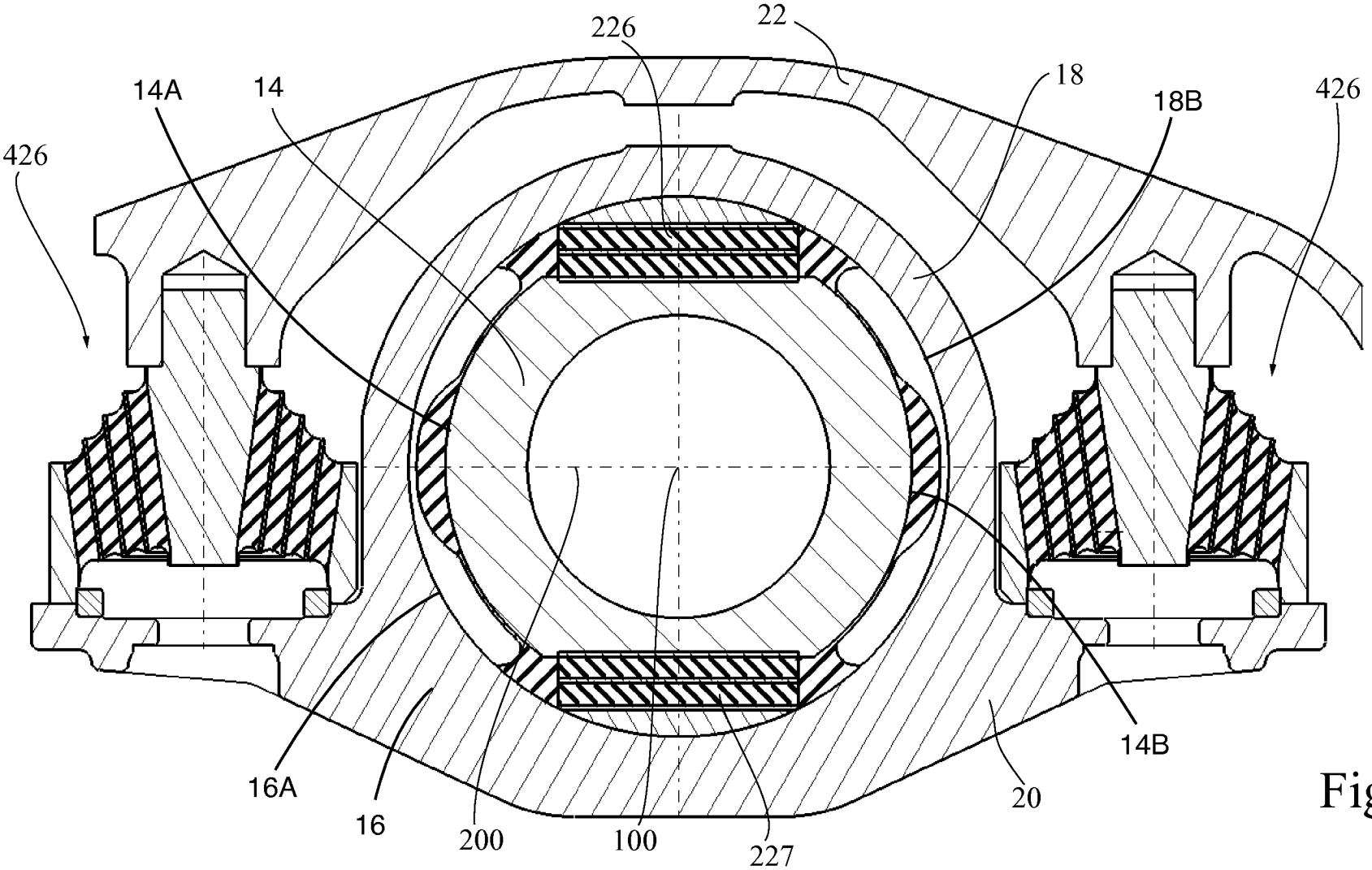
FIG. 8 is a longitudinal section of a wheel axle guiding assembly according to a fourth embodiment of the invention.

The axle guiding assemblies of the various embodiments of FIGS. 1 to 7 are particularly adapted to a running gear with a flexible running gear frame that will undergo deformation to respond to vertical load. The embodiment of FIG. 8 is more adapted to a rigid running gear frame, which remains substantially without deformation under the usual operative conditions. The axle guiding assembly 10 of FIG. 8 differs from the axle guiding assembly of FIGS. 6 and 7 essentially in that the ring-shaped axle box carrier 20 is not rigidly fixed to the running gear frame 22. Instead, the running gear frame 22 bears on a pair of vertical primary suspension units 426, which consist in rubber springs that allow a substantial relative vertical movement between the running gear frame 22 and the axle box carrier 20 and transmit the longitudinal and lateral loads without substantial deformations. The upper and lower elastomeric pads 226, 227 between the axle box carrier 20 and the axle box 14 can be kept very stiff to substantially reduce the relative vertical and transverse motion between the axle box carrier 20 and the axle box 14 and limit the deformation of the elastomeric body 40 of each of the front and read hydro-mechanical converters 32, 34 in directions perpendicular to the longitudinal direction 200. The response of the wheel axle guiding assembly 10 of FIG. 8 to static and dynamic longitudinal loads is essentially similar to that of the previous embodiments.

Figure 9:
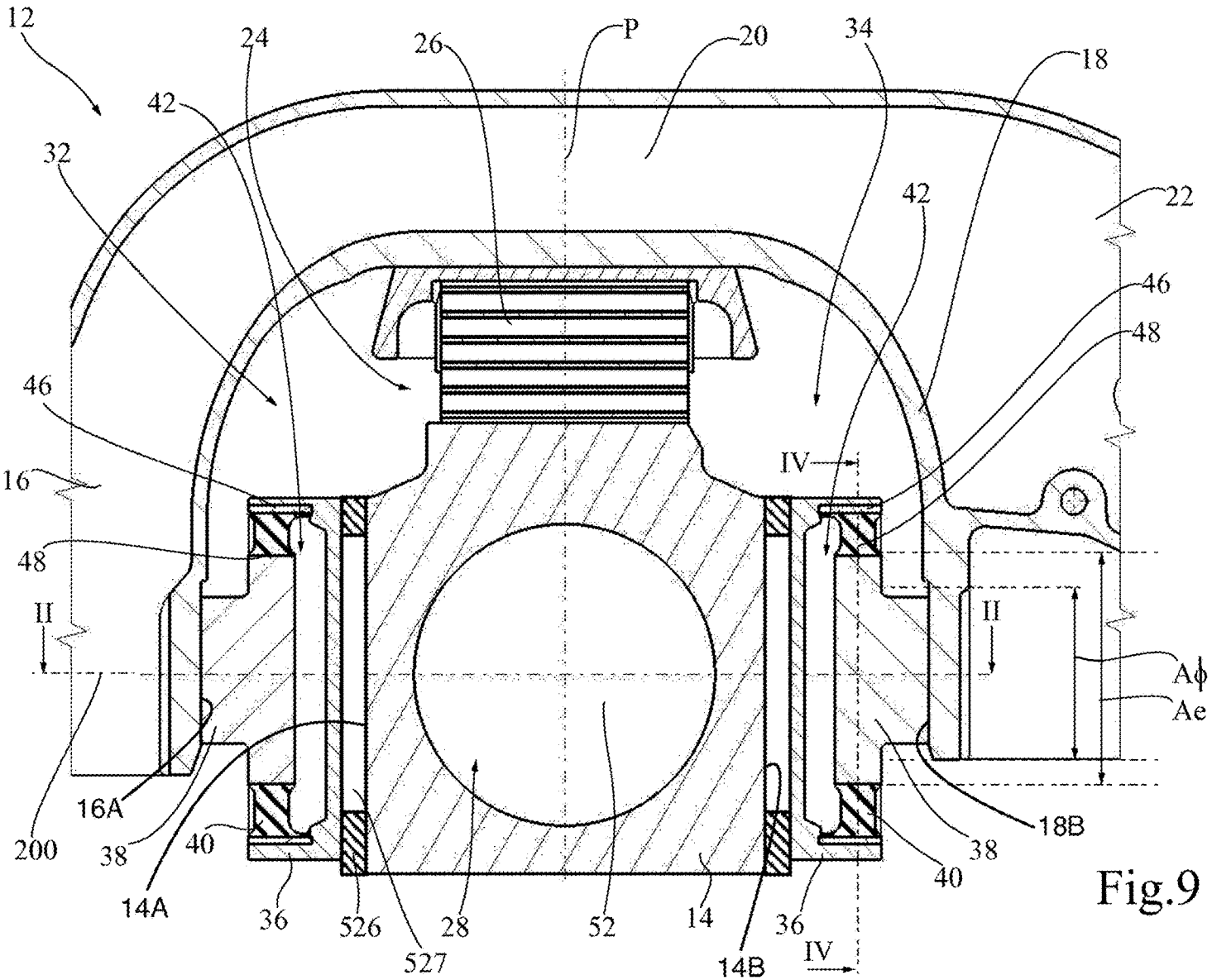
FIG. 9 is a longitudinal section of a wheel axle guiding assembly according to a fifth embodiment of the invention.

The axle box guiding assembly of FIG. 9 derives from the embodiment of FIGS. 1 to 4 and differs from that embodiment in that an additional spring 526 is interposed between the axle box 14 and each of the longitudinal hydro-mechanical converter 32, 34. This additional decoupling spring 526 has vertical stiffness less than two times the vertical stiffness of the hydro-mechanical converter 32, 34, a longitudinal stiffness at least ten times greater than the longitudinal stiffness of the hydro-mechanical converter 32, 34 and a lateral stiffness less than two times than the lateral stiffness of the hydro-mechanical converter 32, 34. The decoupling spring 526 can be an elastomer ring around a fixed volume hydraulic chamber 527 filled with hydraulic fluid.

Figure 10:
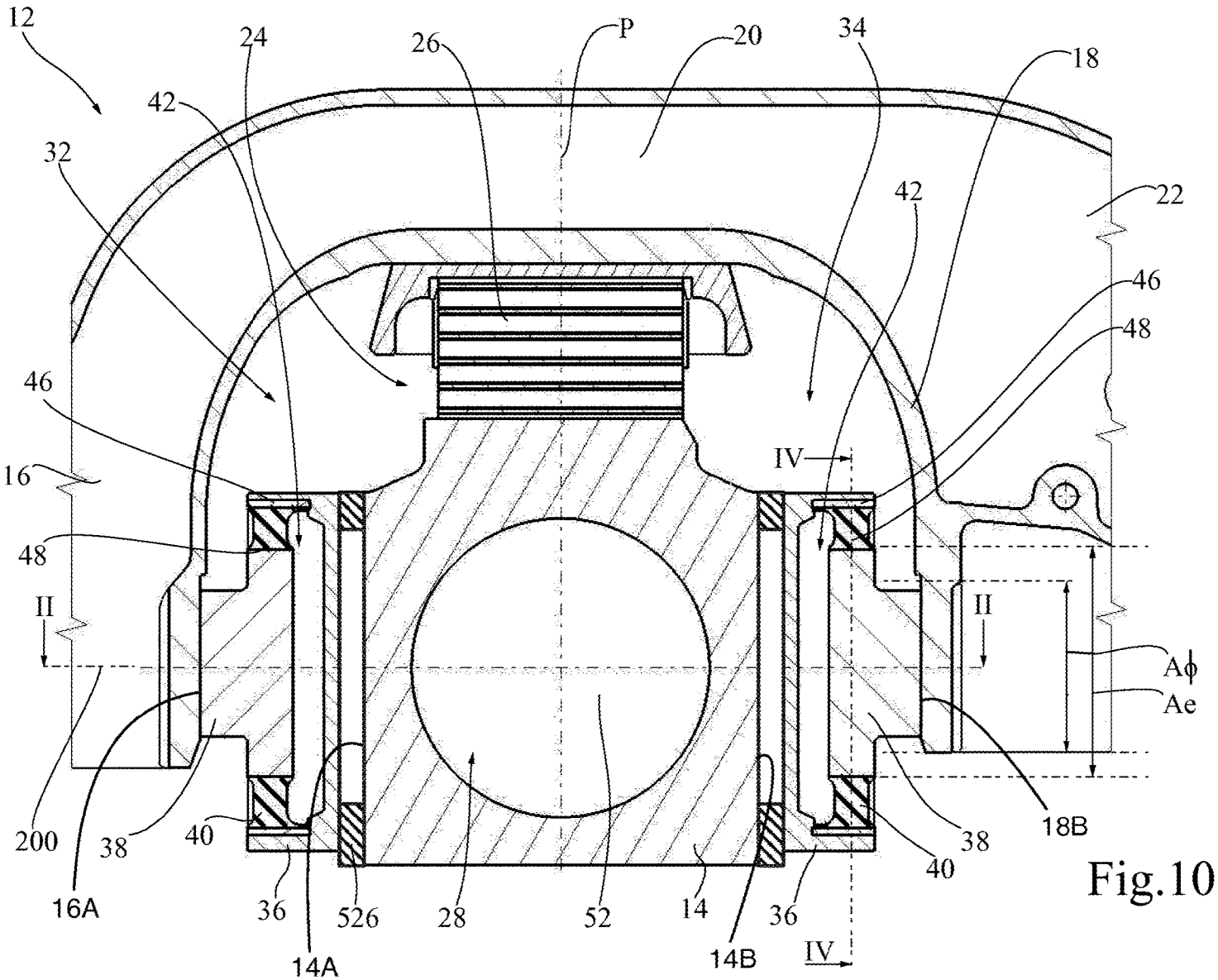
FIG. 10 is a longitudinal section of a wheel axle guiding assembly according to a sixth embodiment of the invention.

The axle box guiding assembly of FIG. 10 derives from the embodiment of FIG. 9 and differs from that embodiment merely in that no fixed volume hydraulic chamber is provided.

Figure 11:
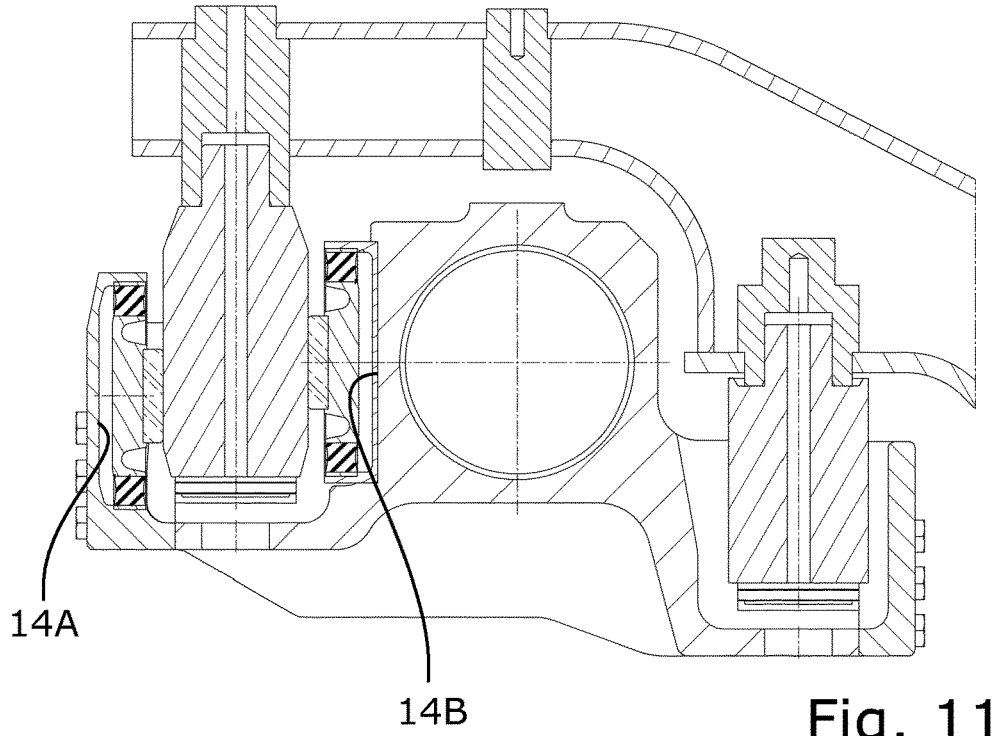
FIG. 11 is a longitudinal section of a wheel axle guiding assembly according to a seventh embodiment of the invention.
Figure 12:
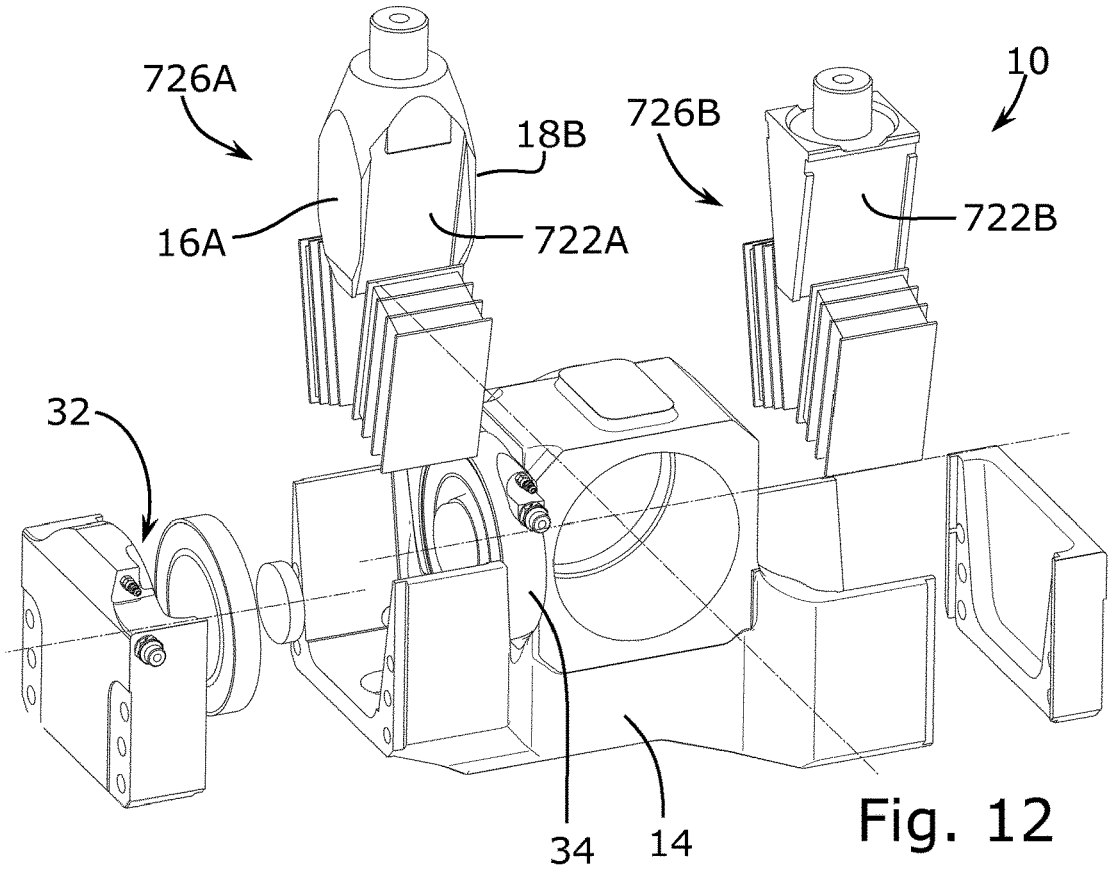
FIG. 12 is an exploded view o the wheel axle guiding assembly of FIG. 10.

A wheel axle guiding assembly 10 for a running gear 12 of a rail vehicle according to a seventh embodiment of the invention is illustrated in FIGS. 11 to 12. This wheel axle guiding assembly 10 comprises an axle box 14 and an axle box carrier 20 formed by an end portion of a frame 22 of the running gear 12, supported on the axle box 14 by means of a primary suspension 24, which comprises a front vertical primary suspension unit 726A and a rear a vertical primary suspension unit 726B. The axle box 14 is located longitudinally between the front and rear suspension units 726A, 726B, which comprise each a chevron spring having a V-shaped cross-section in a vertical transversal plane parallel to a revolution axis 100 defined by the axle box 14.

The axle box guiding assembly of FIG. 11 and FIG. 12 is provided with a front longitudinal hydro-mechanical converter 32, which is fixed to a front interface 14A of the axle box 14 and to a front interface 16A of the axle box carrier 20 formed by a front face of a front pillar 722A that is integral with the frame 22 of the running gear 12 and extends between the inclined portions of the front chevron spring 726A. The axle box guiding assembly of FIG. 11 and FIG. 12 is further provided with a rear longitudinal hydro-mechanical converter 34, which is fixed to a rear interface 14B of the axle box 14 and to a rear interface 16B of the axle box carrier 20 formed by a rear face of the front pillar 722A. Unlike the previous embodiments, the front interface 14A and rear interface 14B of the axle box 14 face each other and the front interface 16B and rear interface 16B of the axle box carrier are located between the front interface 14A and rear interface 14B of the axle box 14. This embodiment is particularly suitable for retrofitting a running gear 12, when little space is available between the axle box 14 and the rear vertical primary suspension unit 726B.

Obviously, if there is more space between the axle box 14 and the rear vertical primary suspension unit 726B than between the axle box 14 and the front vertical primary suspension unit 726A, the front and rear longitudinal hydro-mechanical converter 32, 34 can be located on both longitudinal sides of the rear pillar 722B of the rear vertical primary suspension unit 726B.

It is also possible to provide the front longitudinal hydro-mechanical converter 32 and the rear longitudinal hydro-mechanical converter 34 at both longitudinal ends of axle box 14 such that the front pillar 722A and the rear pillar 722B are located between the front and rear longitudinal hydro-mechanical converters 32, 34. This variant is particularly advantageous if there is more room available in front of the front pillar 722A (i.e. left from the front pillar in FIG. 11) and behind the rear pillar 722B (i.e. right from the rear pillar in FIG. 11) than between each of the front and rear pillars 722A, 722B and the central ring-shaped part of the axle box 14.

According to another embodiment, it is also possible to provide the front longitudinal hydro-mechanical converter 32 between the front pillar 722A and the revolution axis 100 and rear pillar 722B between the revolution axis 100 and the rear longitudinal hydro-mechanical converter 34. Alternatively, it is also possible to provide the rear longitudinal hydro-mechanical converter 34 between the rear pillar 722B and the revolution axis 100 and front pillar 722A between the revolution axis 100 and the front longitudinal hydro-mechanical converter 32.

Figure 13:
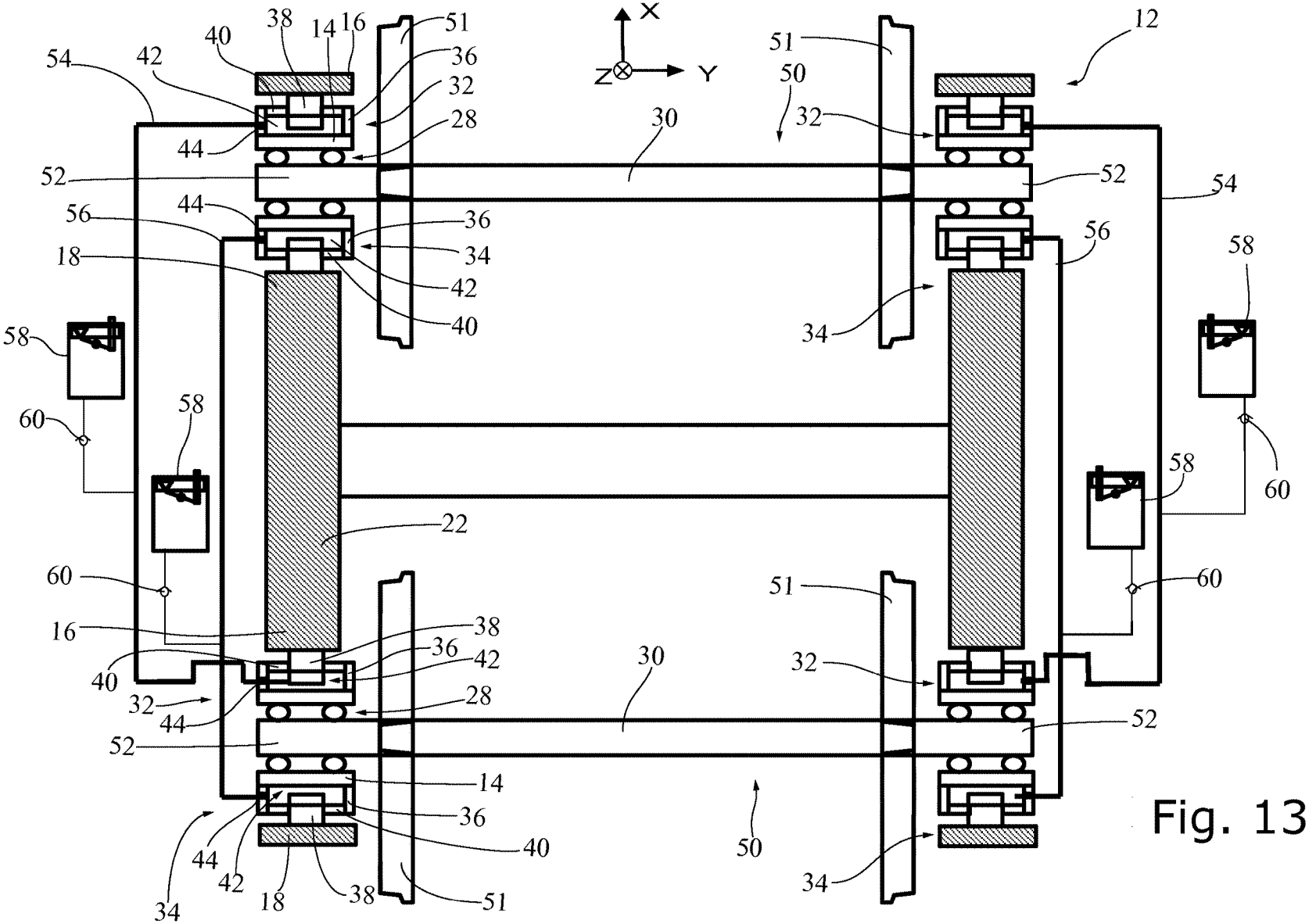
FIG. 13 is a schematic view of a first embodiment of a running gear provided with sets of the wheel axle guiding assemblies according to any one of the previous embodiments of the invention.

A running gear 12 including two pairs of wheel axle guiding assemblies according to the invention is illustrated in FIG. 13. In FIG. 13, the vertical primary suspension units have been left out for simplicity. The running gear 12 of FIG. 13 is a bogie with a two-wheel sets 50, each comprising left and right wheels 51 at opposite ends 52 of a wheel axle 30. Each end 52 of each wheel axle 30 is guided for rotation in an axle box 14 of a wheel axle guiding assembly 10. The two wheel axle guiding assemblies 10 on the same left or right side of the running gear 12 are hydraulically connected with one another via four independent hydraulic circuits 54, 56. More specifically, the variable volume hydraulic chamber 42 of the front hydro-mechanic converters 32 of the front and rear wheel axle guiding assemblies 10 on the left side are connected with one another via a hydraulic circuit 54 and the variable volume hydraulic chamber 42 of the rear hydro-mechanic converters 34 of the front and rear wheel axle guiding assemblies 10 on the left side are connected with one another via a hydraulic circuit 56. Similar hydraulic connections are provided between the axle guiding assemblies 10 on the right side of the running gear 10. A hydraulic reservoir 58 is connected via a check valve 60 to each of the hydraulic circuits to provide a temperature and leakage compensation. Preferably, each hydraulic reservoir 58, or more generally each hydraulic circuit 52, 54, is provided with a leakage detector 63. This type of hydraulic link between the front and rear axle will result in passive steering of the front and rear axles 30 in opposite directions.

Figure 14:
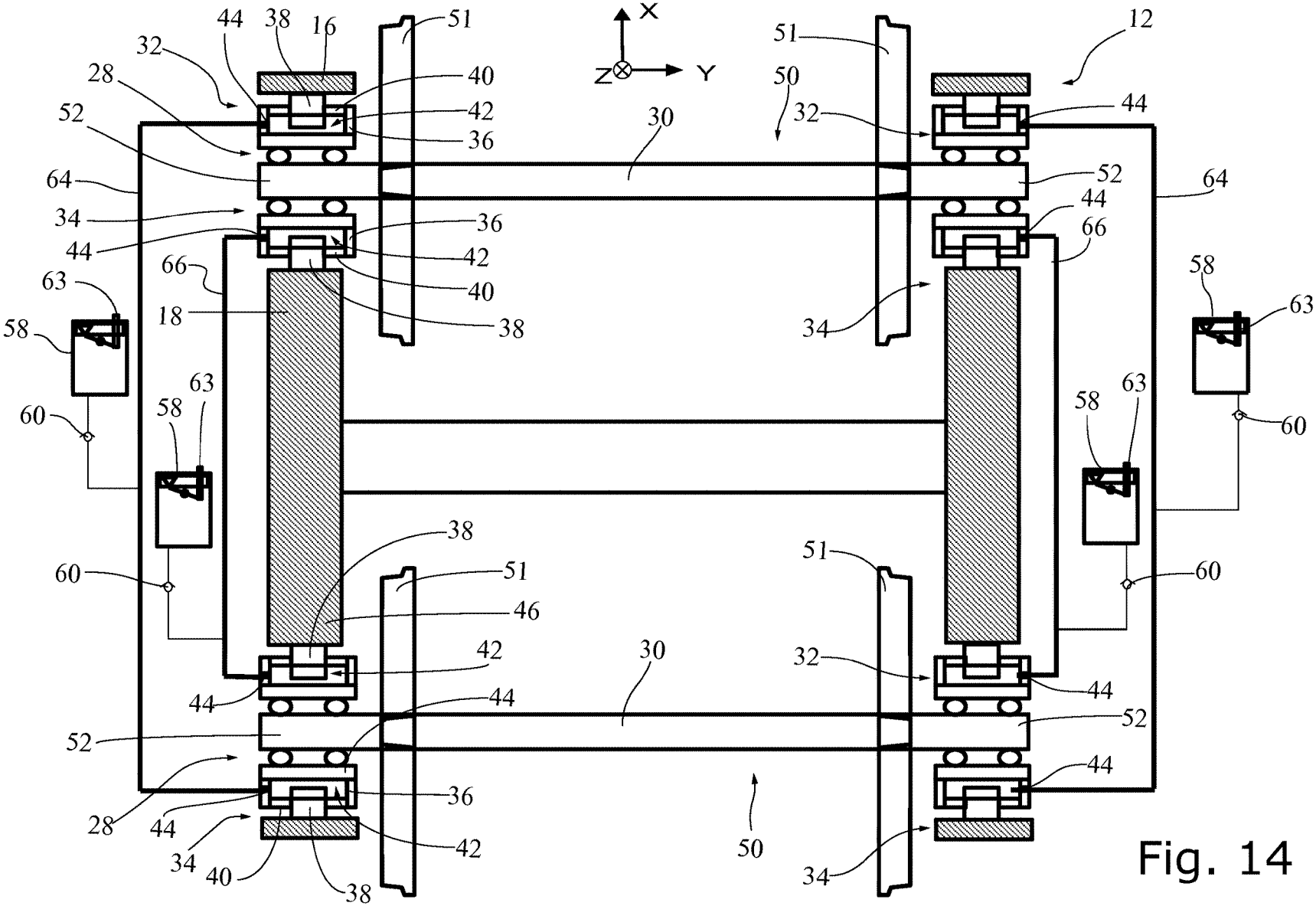
FIG. 14 is a schematic view of a second embodiment of a running gear provided with sets of the wheel axle guiding assemblies according to any one of the previous embodiments of the invention.

An alternative connection between the individual variable volume hydraulic chambers 42 is shown in FIG. 14. The variable volume hydraulic chamber 42 of the front hydro-mechanic converters 32 of the front wheel axle guiding assembly 10 on each side is connected with the variable volume hydraulic chamber 42 of the rear hydro-mechanic converters 34 of the rear wheel axle guiding assembly 10 on the same side of the running gear 12 via a hydraulic circuit 64, while the variable volume hydraulic chamber 42 of the rear hydro-mechanic converters 34 of the front wheel axle guiding assembly 10 on each side is connected with the variable volume hydraulic chamber 42 of the front hydro-mechanic converters 32 of the rear wheel axle guiding assembly 10 on the same side of the running gear via a hydraulic circuit 66. This type of hydraulic link between the front and rear axle will result in passive steering of the front and rear axles in the same direction.

Figure 15:
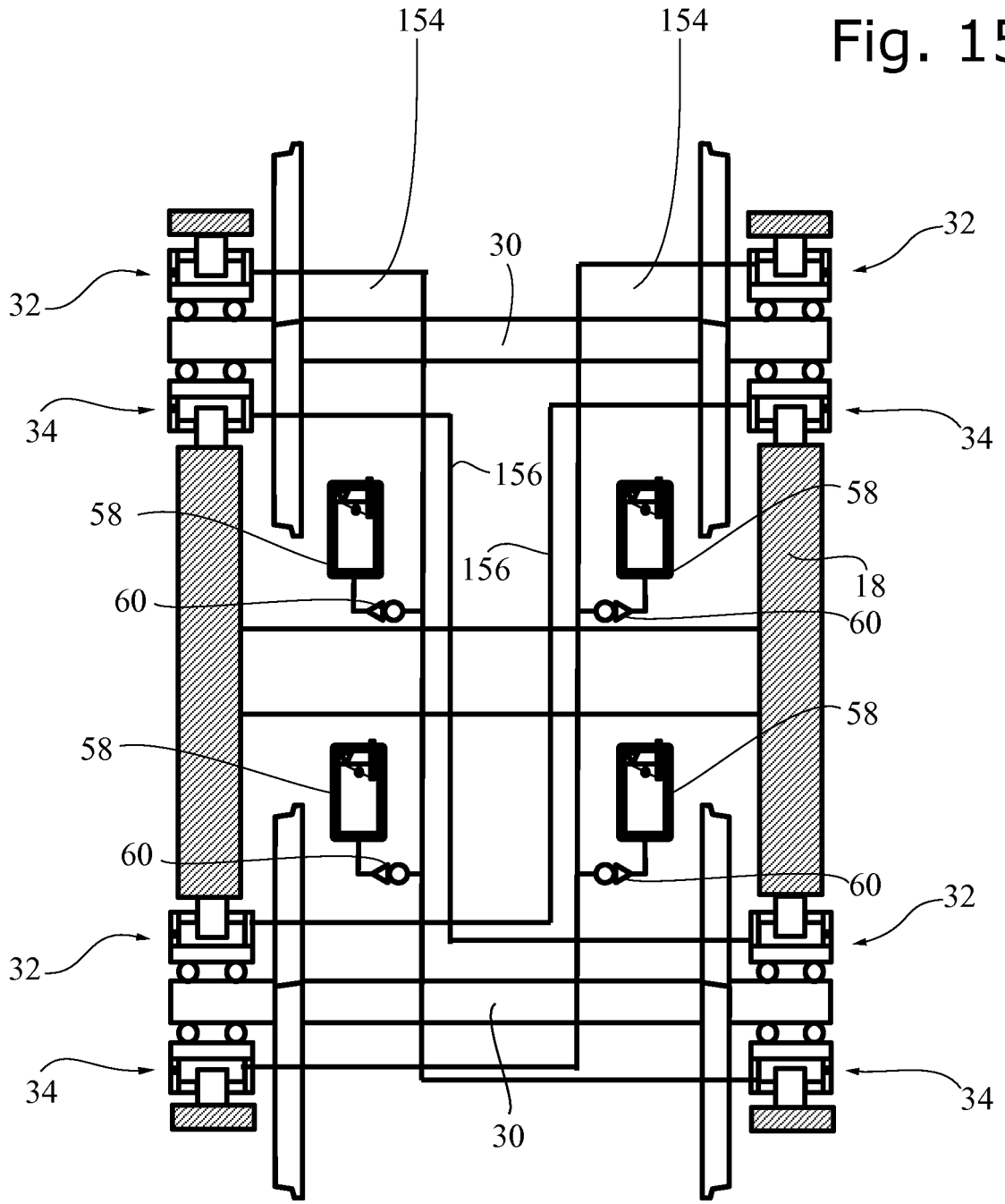
FIG. 15 is a schematic view of a third embodiment of a running gear provided with sets of the wheel axle guiding assemblies according to any one of the previous embodiments of the invention.

An alternative connection between the individual variable volume hydraulic chambers 42 is shown in FIG. 15. The variable volume hydraulic chamber 42 of the front hydro-mechanic converters 32 of the front wheel axle guiding assembly 10 on each side is connected with the variable volume hydraulic chamber 42 of the rear hydro-mechanic converters 34 of the rear wheel axle guiding assembly 10 on the other side of the running gear 12 via a hydraulic circuit 154, while the variable volume hydraulic chamber 42 of the rear hydro-mechanic converters 34 of the front wheel axle guiding assembly 10 on each side is connected with the variable volume hydraulic chamber 42 of the front hydro-mechanic converters 32 of the rear wheel axle guiding assembly 10 on the other side of the running gear via a hydraulic circuit 156. This type of hydraulic link between the front and rear axle will result in passive steering of the front and rear axles in opposite directions.

It may be appropriate to provide the running gear with additional distribution valves so as to switch configurations between two types of hydraulic circuits depending on the revolution speed of one of the wheel axles, e.g. with the configuration of FIG. 13 or FIG. 15 at low speed and the configuration of FIG. 14 at higher speed.

Figure 16:
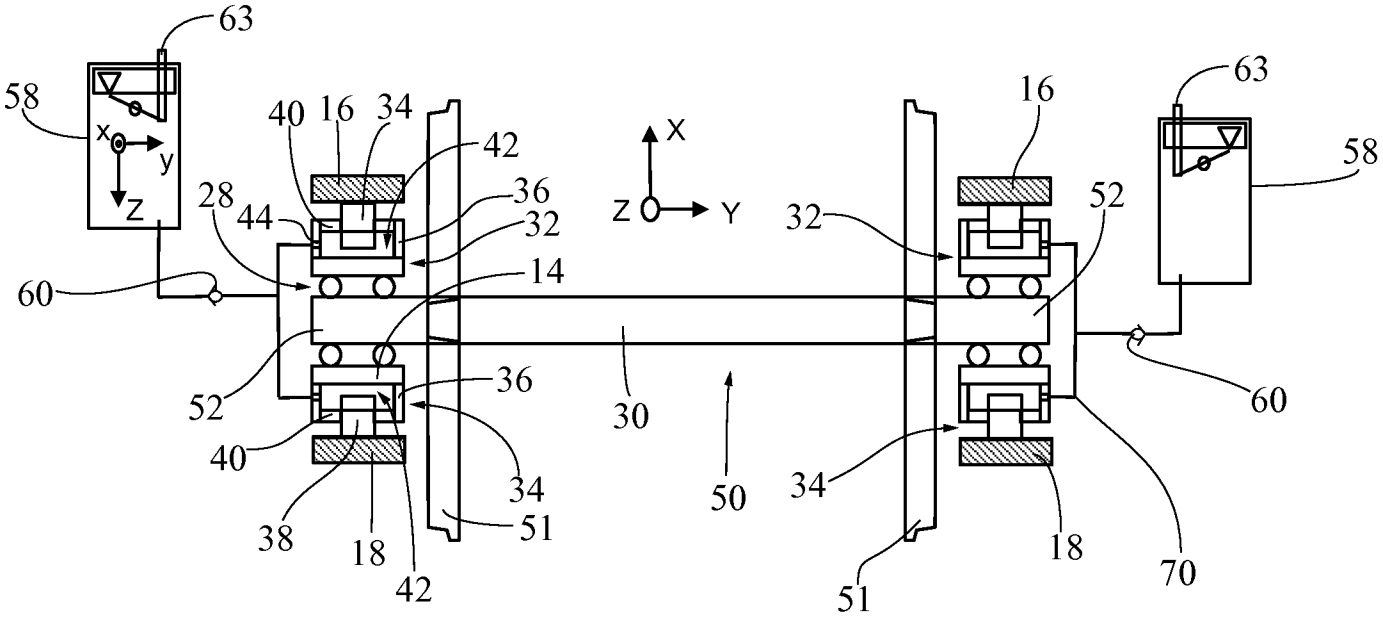
FIG. 16 is a schematic view of a fourth embodiment of a running gear provided with sets of the wheel axle guiding assemblies according to any one of the previous embodiments of the invention.

A wheel set 50 provided with two wheel axle guiding assemblies 10 according to the invention for guiding the two opposite ends 52 of a wheel axle 30 is illustrated in FIG. 16. Two independent hydraulic circuits 68, 70 are formed, each to connect the variable volume hydraulic chamber 42 of the front hydro-mechanic converters 32 of one wheel axle guiding assembly 10 with the variable volume hydraulic chamber 42 of the rear hydro-mechanic converters 34 of the same wheel axle guiding assembly 10. A hydraulic reservoir 58 is provided in each of the hydraulic circuits 68, 70. This embodiment can be implemented in a one-axle running gear or in a two-axle bogie.

Figure 17:
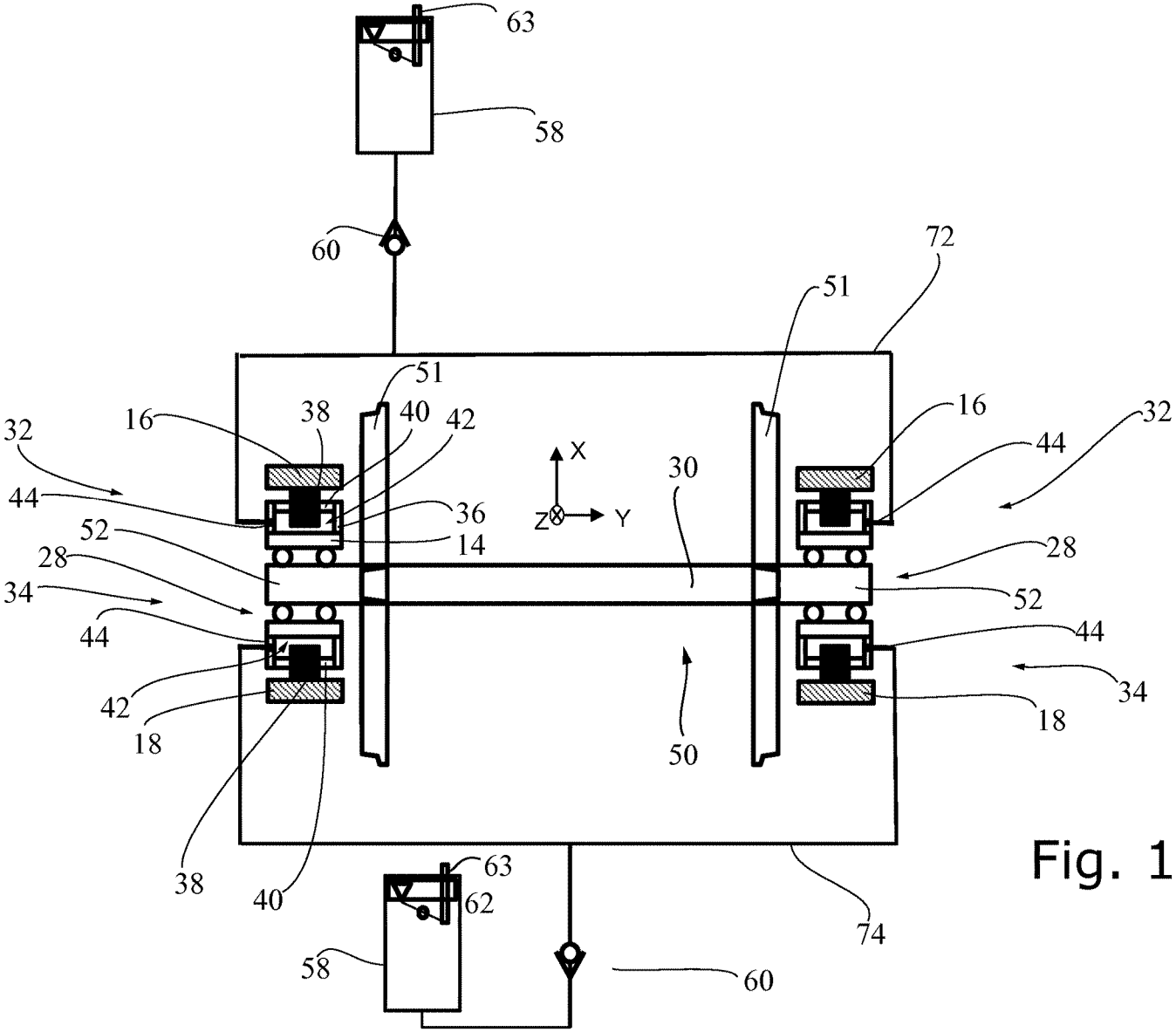
FIG. 17 is a schematic view of a fifth embodiment of a running gear provided with sets of the wheel axle guiding assemblies according to any one of the previous embodiments of the invention.

An alternative connection between the individual variable volume hydraulic chambers 42 is shown in FIG. 17. Two independent hydraulic circuits 72, 74 are formed, one to connect the variable volume hydraulic chambers 42 of the front hydro-mechanic converters 32 of the left and right wheel axle guiding assemblies 10 with one another and another one to connect the variable volume hydraulic chamber 42 of the rear hydro-mechanic converters 32 of the left and right wheel axle guiding assemblies. A hydraulic reservoir 58 is provided in each of the hydraulic circuits 72, 74. This embodiment can be implemented in a one-axle running gear or in a two-axle bogie. This embodiment is particularly advantageous as it combines a very low static stiffness for rotation about the vertical axis with a limitation of translation movement of the axle parallel to the longitudinal axis. This is particularly helpful to preserve the steerability when the vehicle brakes or accelerates, the longitudinal forces being transmitted with minimal longitudinal translation of the axle.

Figure 18:
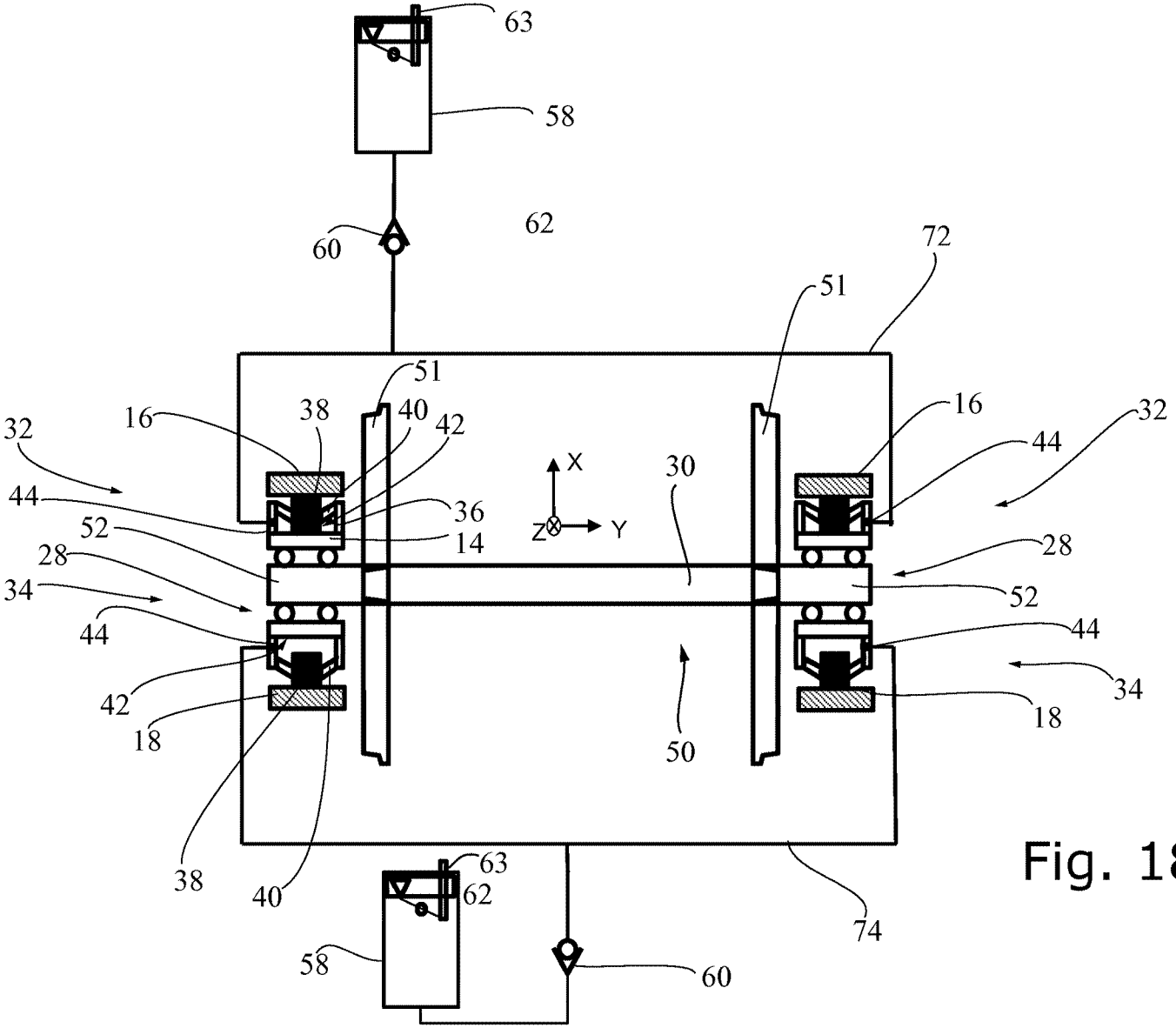
FIG. 18 is a schematic view of running gear of FIG. 17, operating in a fail-safe mode of operation.

Moreover, this embodiment provides a fail-safe operating mode illustrated in FIG. 18. If one of the hydraulic circuits leaks (in FIG. 18, the hydraulic circuit 72) and there is not enough hydraulic fluid left in that circuit, the reservoir 58 of the other hydraulic circuit will provide additional fluid in that circuit to force the wheel axle 30 towards the abutment position illustrated in FIG. 18. In this position, the wheel set 50 will not be able to rotate about the vertical axis, but will remain in a stable position. To this end, each reservoir 58 should preferably have a capacity superior to the volume of the respective hydraulic circuit, i.e. in practice at least twice and preferably more than twice the volume of the hydraulic chambers 42.

While the above examples illustrate preferred embodiments of the present invention it is noted that various other arrangements can also be considered, in particular combinations of features from different embodiments.

The invention claimed is:

1. A wheel axle guiding assembly comprising:

an axle box defining a horizontal revolution axis and a longitudinal horizontal direction perpendicular to the revolution axis;

an axle box carrier; and a front longitudinal hydro-mechanical converter fixed to a front interface of the axle box and a front interface of the axle box carrier and a rear longitudinal hydro-mechanical converter fixed to a rear interface of the axle box and a rear interface of the axle box carrier to allow a fore-and-aft movement of the axle box relative to the axle box carrier parallel to the longitudinal direction;

wherein each of the front and rear longitudinal hydro-mechanical converters includes a housing, a plunger and an elastomeric body fixed to the housing and to the plunger so as to allow a fore-and-aft relative movement parallel to the longitudinal direction between the plunger and the housing, a single variable volume hydraulic chamber being formed between the housing, the plunger and the elastomeric body, wherein a motion of the plunger relative to the housing in an increase direction parallel to the longitudinal direction results in a volume increase of the variable volume hydraulic chamber while a motion of the plunger relative to the housing in a decrease direction opposite to the increase direction and parallel to the longitudinal direction results in a volume decrease of the variable volume hydraulic chamber, each of the front and rear longitudinal hydro-mechanical converters further including a hydraulic port for connecting the variable volume hydraulic chamber to an external hydraulic circuit.

2. The wheel axle guiding assembly of claim 1, wherein the axle box houses a bearing having an inner diameter defining a cross-sectional area $A_{\Phi}$ of an end of a wheel axle to be received in the bearing and the plunger has an effective area $A_e$ measured in a plane perpendicular to the longitudinal direction, which is greater than half the cross-sectional area $A_\Phi$.

3. The wheel axle guiding assembly of claim 1, wherein each of the front and rear longitudinal hydro-mechanical converters has a longitudinal stiffness, which increases with a frequency of the fore-and-aft movement of the axle box relative to the axle box carrier from a quasistatic stiffness value to a dynamic stiffness value, wherein the plunger and the elastomeric body have dimensions such that a ratio R of the dynamic stiffness value to the quasistatic stiffness value is greater than 10.

4. The wheel axle guiding assembly of claim 1, further comprising a vertical suspension unit provided between the axle box and an upper part of the axle box carrier.

5. The wheel axle guiding assembly of claim 1, wherein each of the front and rear longitudinal hydro-mechanical converters further comprises a decoupling spring with a longitudinal stiffness at least ten times greater than a longitudinal stiffness of the elastomeric body, a lateral stiffness less than two times the lateral stiffness of the elastomeric body and a vertical stiffness less than two times the vertical stiffness of the elastomeric body.

6. The wheel axle guiding assembly of claim 1, wherein the front interface of the axle box faces the front interface of the axle box carrier and the rear interface of the axle box faces the rear interface of the axle box carrier.

7. The wheel axle guiding assembly of claim 1, wherein the front interface and the rear interface of the axle box are located between the front interface and the rear interface of the axle box carrier.

8. The wheel axle guiding assembly of claim 1, wherein the horizontal revolution axis is located longitudinally between the front interface and a rear interface of the axle box carrier.

9. The wheel axle guiding assembly of claim 8, wherein the axle box carrier forms a ring around the axle box.

10. The wheel axle guiding assembly of claim 1, further comprising a vertical suspension assembly for connecting the axle box carrier to a running gear frame.

11. The wheel axle guiding assembly of claim 1, wherein the axle box carrier is a constituent portion of a running gear frame of a running gear.

12. The wheel axle guiding assembly of claim 11, wherein the running gear frame is flexible.

13. The wheel axle guiding assembly of claim 1, further comprising at least one hydraulic reservoir hydraulically connected to the hydraulic chambers.

14. A running gear for a rail vehicle, comprising at least a pair of wheel axle guiding assemblies, each wheel axle guiding assembly comprising:

an axle box defining a horizontal revolution axis and a longitudinal horizontal direction perpendicular to the revolution axis;

an axle box carrier; and a front longitudinal hydro-mechanical converter fixed to a front interface of the axle box and a front interface of the axle box carrier and a rear longitudinal hydro-mechanical converter fixed to a rear interface of the axle box and a rear interface of the axle box carrier to allow a fore-and-aft movement of the axle box relative to the axle box carrier parallel to the longitudinal direction;

each of the front and rear longitudinal hydro-mechanical converters includes a housing, a plunger and an elastomeric body fixed to the housing and to the plunger so as to allow a fore-and-aft relative movement parallel to the longitudinal direction between the plunger and the housing, a single variable volume hydraulic chamber being formed between the housing, the plunger and the elastomeric body, wherein a motion of the plunger relative to the housing in an increase direction parallel to the longitudinal direction results in a volume increase of the variable volume hydraulic chamber while a motion of the plunger relative to the housing in a decrease direction opposite to the increase direction and parallel to the longitudinal direction results in a volume decrease of the variable volume hydraulic chamber, each of the front and rear longitudinal hydro-mechanical converters further including a hydraulic port for connecting the variable volume hydraulic chamber to an external hydraulic circuit, the running gear for a rail vehicle also comprising a first hydraulic circuit for establishing a hydraulic connection between a first variable volume hydraulic chamber and a second variable volume hydraulic chamber, and a second hydraulic circuit for establishing a hydraulic connection between a third variable volume hydraulic chamber and a fourth variable volume hydraulic chamber, the first, second, third and fourth variable volume hydraulic chambers being all different chambers and each of the first, second, third and fourth variable volume hydraulic chambers being the variable volume hydraulic chamber of one of the front and rear longitudinal hydro-mechanical converters of one of the wheel axle guiding assemblies of the pair of wheel axle guiding assemblies.

15. The running gear of claim 14, wherein the first hydraulic circuit establishes a hydraulic connection between the variable volume hydraulic chamber of the front longitudinal hydro-mechanical converter of one of the wheel axle guiding assemblies of the pair of the wheel axle guiding assemblies and the variable volume hydraulic chamber of the front longitudinal hydro-mechanical converter of the other of the wheel axle guiding assemblies of the pair of the wheel axle guiding assemblies and second hydraulic circuit establishes a hydraulic connection between the variable volume hydraulic chamber of the rear longitudinal hydro-mechanical converter of one of the wheel axle guiding assemblies of the pair of the wheel axle guiding assemblies and the variable volume hydraulic chamber of the rear longitudinal hydro-mechanical converter of the other of the wheel axle guiding assemblies of the pair of the wheel axle guiding assemblies.

16. The running gear of claim 14, further comprising at least a front wheel set and a rear wheel set, wherein an end of the front wheel set is supported by the axle box of a front wheel axle guiding assembly of the pair of wheel axle guiding assemblies, and an end of the rear wheel set is supported by the axle box of a rear wheel axle guiding assembly of the pair of wheel axle guiding assemblies.

17. The running gear of claim 14, further comprising at least one wheel set, wherein a left end of the wheel set is supported by the axle box of a left wheel axle guiding assembly of the pair of wheel axle guiding assemblies, and a right end of the wheel set is supported by the axle box of a right wheel axle guiding assembly of the pair of wheel axle guiding assemblies.

18. The running gear of claim 14, wherein the running gear does not include any hydraulic connection between the chamber of the front longitudinal hydro-mechanical converter and the chamber of the rear longitudinal hydro-mechanical converter of the same wheel axle guiding assembly.

19. The wheel axle guiding assembly of claim 13, wherein a check valve allows a flow of a fluid only from the hydraulic reservoir to the hydraulic chambers, wherein the hydraulic reservoir volume is at least twice the volume of the hydraulic chambers.

* * * * *